US010704775B2

(12) United States Patent
Vavruskova et al.

(10) Patent No.: US 10,704,775 B2
(45) Date of Patent: Jul. 7, 2020

(54) ADJUSTABLY CONFIGURABLE SUSPENDED FIXTURES, LIGHTING FIXTURES, AND METHOD FOR SUSPENDING FIXTURES AND LIGHTING FIXTURES

(71) Applicant: Swarovski Lighting, Ltd., Plattsburgh, NY (US)

(72) Inventors: Marcela Vavruskova, Jablonec nad Nisou (CZ); Andrew M. Schuyler, Colchester, VT (US); Jerrid E. Ayen, Plattsburgh, NY (US)

(73) Assignee: Swarovski Lighting, Ltd., Plattsburgh, NY (US)

( * ) Notice: Subject to any disclaimer, the term of this patent is extended or adjusted under 35 U.S.C. 154(b) by 397 days.

(21) Appl. No.: 15/474,627

(22) Filed: Mar. 30, 2017

(65) Prior Publication Data

US 2018/0274769 A1 Sep. 27, 2018

Related U.S. Application Data

(60) Provisional application No. 62/476,238, filed on Mar. 24, 2017.

(51) Int. Cl.
*F21V 21/008* (2006.01)
*F21V 21/16* (2006.01)
(Continued)

(52) U.S. Cl.
CPC ..... *F21V 21/16* (2013.01); *F21S 8/061* (2013.01); *F21V 21/008* (2013.01); *F21V 21/03* (2013.01); *F21V 23/001* (2013.01)

(58) Field of Classification Search
CPC ..... F21V 21/008; F21V 21/14; F21V 21/16; F21V 21/18; F21V 21/20; F21S 8/06; F21S 8/061; F21S 8/068; F16M 13/027
(Continued)

(56) References Cited

U.S. PATENT DOCUMENTS 4,685,648 A * 8/1987 Dobner ..... F16F 15/28 248/123.11
5,317,493 A * 5/1994 Muller ..... F21S 2/00 362/403

(Continued)

FOREIGN PATENT DOCUMENTS

DE 19845752 4/2000
EP 1906080 4/2008

(Continued)

OTHER PUBLICATIONS

Loft Vintage Retro Iron Black Chandelier Industrial pulley industrial lamp E27 Edison Pendant Lamp Home Lighting Fixtures, available from AliExpress.com, printout available on Mar. 16, 2017, at https://www.aliexpress.com/item/Loft-Vintage-Retro-Iron-Black-Chandelier-Industrial-pulley-industrial-lamp-E27-Edison-Pendant-Lamp-Home-Lighting/32408166321.html?spm=2114.40010708.4.9.4ncwga, 14 pages, at least as early as Mar. 16, 2017.

(Continued)

*Primary Examiner* — Jonathan Liu
*Assistant Examiner* — Guang H Guan
(74) *Attorney, Agent, or Firm* — Heslin Rothenberg Farley and Mesiti PC

(57) ABSTRACT

A fixture such as a light fixture includes, for example, a first lower support, and a first cord and a second cord for suspending the first lower support. Lower portions of the first and second cords are attachable to the first lower support. An upper cord support is attachable to upper portions of the first and second cords. The upper cord support is operable to fixedly position the upper portions of the first and second cords over a range of different positions so that the first lower support is fixedly maintainable at different angles relative to the ground. A fixture may include a second lower support and the upper cord support may be operable to independently fixedly position the upper por- (Continued)

tions of the third and fourth cords over a range of different positions so that the second lower support is fixedly maintainable at different angles relative to the ground.

35 Claims, 26 Drawing Sheets

(51) Int. Cl.
*F21S 8/06* (2006.01)
*F21V 21/03* (2006.01)
*F21V 23/00* (2015.01)

(58) Field of Classification Search
USPC ..... 362/249.01, 249.03, 249.04, 249.07, 362/249.08, 391, 407; 248/317, 327, 248/328; D26/90
See application file for complete search history.

(56) References Cited

U.S. PATENT DOCUMENTS

| | | | | |
|---|---|---|---|---|
| 6,202,361 | B1 * | 3/2001 | Thorp | A47B 5/00 108/149 |
| 6,450,669 | B2 * | 9/2002 | Buss | F21V 21/06 362/217.16 |
| D522,168 | S | 5/2006 | Schuyler | |
| D523,988 | S | 6/2006 | Schuyler et al. | |
| D539,962 | S * | 4/2007 | Hsu | D26/81 |
| D554,285 | S | 10/2007 | Schuyler | |
| D570,527 | S | 6/2008 | Pelzl | |
| D575,440 | S | 8/2008 | Pelzl | |
| D575,442 | S | 8/2008 | Pelzl | |
| 8,057,077 | B2 * | 11/2011 | Gagne | F21V 21/02 362/147 |
| D655,856 | S | 3/2012 | Burks | |
| 8,136,968 | B2 * | 3/2012 | Chiu | F21S 8/06 362/357 |
| D659,882 | S * | 5/2012 | Sterling | F21V 21/06 D26/83 |
| D660,510 | S | 5/2012 | Bracher | |
| D666,354 | S | 8/2012 | Bracher | |
| 8,342,718 | B2 | 1/2013 | Kikoski | |
| D694,949 | S | 12/2013 | Bracher | |
| 8,714,775 | B2 | 5/2014 | Bracher et al. | |
| D728,145 | S * | 4/2015 | Shiqiang | F21S 2/00 D26/88 |
| 9,879,845 | B2 * | 1/2018 | Sonneman | F21S 8/063 |
| D810,346 | S * | 2/2018 | Genovese | F21S 8/063 D26/86 |
| 10,234,616 | B2 * | 3/2019 | Tarsa | F21S 8/06 |
| 2007/0147053 | A1 | 6/2007 | Gagne et al. | |
| 2018/0274769 | A1 * | 9/2018 | Vavruskova | F21S 8/061 |

FOREIGN PATENT DOCUMENTS

| | | |
|---|---|---|
| EP | 2884019 | 6/2015 |
| FR | 608016 | 7/1926 |
| FR | 2470079 | 5/1981 |
| WO | 2012032928 | 3/2012 |

OTHER PUBLICATIONS

Handcrafted 4-Light Steel Beam Chandelier With Hanging Pulley, available from Houzz Inc., printout available on Mar. 16, 2017 at http://www.houzz.com/photos/15378898/Handcrafted-4-Light-Steel-Beam-Chandelier-With-Hanging-Pulley-industrial-chandeliers, 1 page, at least as early as Mar. 16, 2017.

Pulley Table Lamp, available from Capeing.Com, printout available on Mar. 16, 2017, http://capeing.com/lighting/pulley-table-lamp.php, 2 pages, at least as early as Mar. 16, 2017.

Varauskova et al., International Patent Application, entitled "Adjustably Configurable Suspended Fixtures, Lighting Fixtures and Methods for Suspending Fixtures and Lighting Fixtures", PCT/US2017/062687, 55 pages, filed Nov. 21, 2017.

Search Report and Written Opinion, for PCT/US2017/062687, 19 pages, dated Jan. 31, 2018.

* cited by examiner

ADJUSTABLY CONFIGURABLE SUSPENDED FIXTURES, LIGHTING FIXTURES, AND METHOD FOR SUSPENDING FIXTURES AND LIGHTING FIXTURES

CLAIM TO PRIORITY

This application claims the benefit of U.S. Provisional Patent Application No. 62/476,238, filed Mar. 24, 2017, entitled "Adjustably Configurable Suspended Fixtures, Lighting Fixtures, And Method For Suspending Fixtures And Lighting Fixtures", the contents of which are hereby incorporated herein by reference in their entirety.

FIELD OF THE DISCLOSURE

The present disclosure relates generally to fixtures such as lighting fixtures, and more particularly to adjustably configurable suspended fixtures, lighting fixtures, and method for suspending fixtures and lighting fixtures.

BACKGROUND

Chandeliers and pendant lights are lighting devices that hang from a ceiling. Typically, a chandeliers or a pendant light is supported from a ceiling mount by a cord, chain, or pipe with an upper end attached to the ceiling mount, and a lower end attached to the lighting device. The lighting devices often include one or more shades and one or more lights such as one or more light bulbs.

U.S. Pat. No. 8,714,775 issued to Bracher et al. discloses light fixtures, which permit electrical power transmission to light sources, such as LEDs, through the light fixture suspension elements. The light fixtures include a first ring suspended by a plurality of first cords, and a second ring suspended by a plurality of second cords from the first ring. At least one of the first ring and the second ring includes a plurality of light sources. At least one of the plurality of first cords and at least one of the plurality of the second cords are adapted to transmit electrical power to the plurality of light sources.

SUMMARY

Shortcomings of the prior art are overcome and additional advantages are provided through the provision, in one embodiment, of a fixture which includes, for example, a first lower support, a first cord and a second cord for suspending the first lower support, lower portions of the first and second cords attachable to the first lower support, and an upper cord support attachable to upper portions of the first and second cords. The upper cord support is operable to fixedly position the upper portions of the first and second cords over a range of different positions so that the first lower support is fixedly maintainable at different angles relative to the ground.

In another embodiment, the fixture as described above further includes, for example, a second lower support, a third cord and a fourth cord for suspending the second lower support, lower portions of the third and fourth cords attachable to the second lower support, and the upper cord support attachable to upper portions of the third and fourth cords. The upper cord support is operable to fixedly position the upper portions of the third and fourth cords over a range of different positions so that the second lower support is fixedly maintainable at different angles relative to the ground.

In another embodiment, a method includes, for example, suspending a first lower support from a first cord and a second cord, fixedly positioning and maintaining upper portions of the first cord and the second cord to fixedly position and maintain the first lower support at a first angle relative to the ground, and fixedly repositioning and maintaining the upper portions of the first cord and the second cord to fixedly reposition and maintain the first lower support at a second angle different from the first angle relative to the ground.

In another embodiment, a method include, for example, suspending a first lower support from a first cord and a second cord, suspending a second lower support from a third cord and a fourth cord, fixedly positioning and maintaining the upper portions of the first cord and the second cord to fixedly position and maintain the first lower support at a first angle, and independently fixedly positioning and maintaining the upper portions of the third cord and the fourth cord to fixedly position and maintain the second lower support at a second angle different from the first angle relative to the ground.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

BRIEF DESCRIPTION OF THE DRAWINGS

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is generally directed to fixtures and lighting fixtures having suspended elements or portions having an adjustable configuration. For example, fixtures and lighting fixtures according to the present disclosure may include suspension cables attached to one or more lower supports and adjustment of the suspension cables to allow angular adjustment of the one or more lower supports so that fixture and lighting fixtures are maintainable with the one or more lower supports disposed in a range of different fixed configurations. For example, the suspension cables may be attached to one or more upper cords supports such as one or more rotatable members which allow one or more lower supports such as one or more rings to be adjusted at a variety of angles based on the user's preference. In some embodiments, the suspension cables from the upper cord support to the one or more lower supports may be configured for carrying electrical power to lighting sources such as LEDs disposed in the one or more lower supports or rings. The lower supports may also support ornaments or a crystal trim, which crystal trim may be arranged by a user according to their preference.

Figure 1:
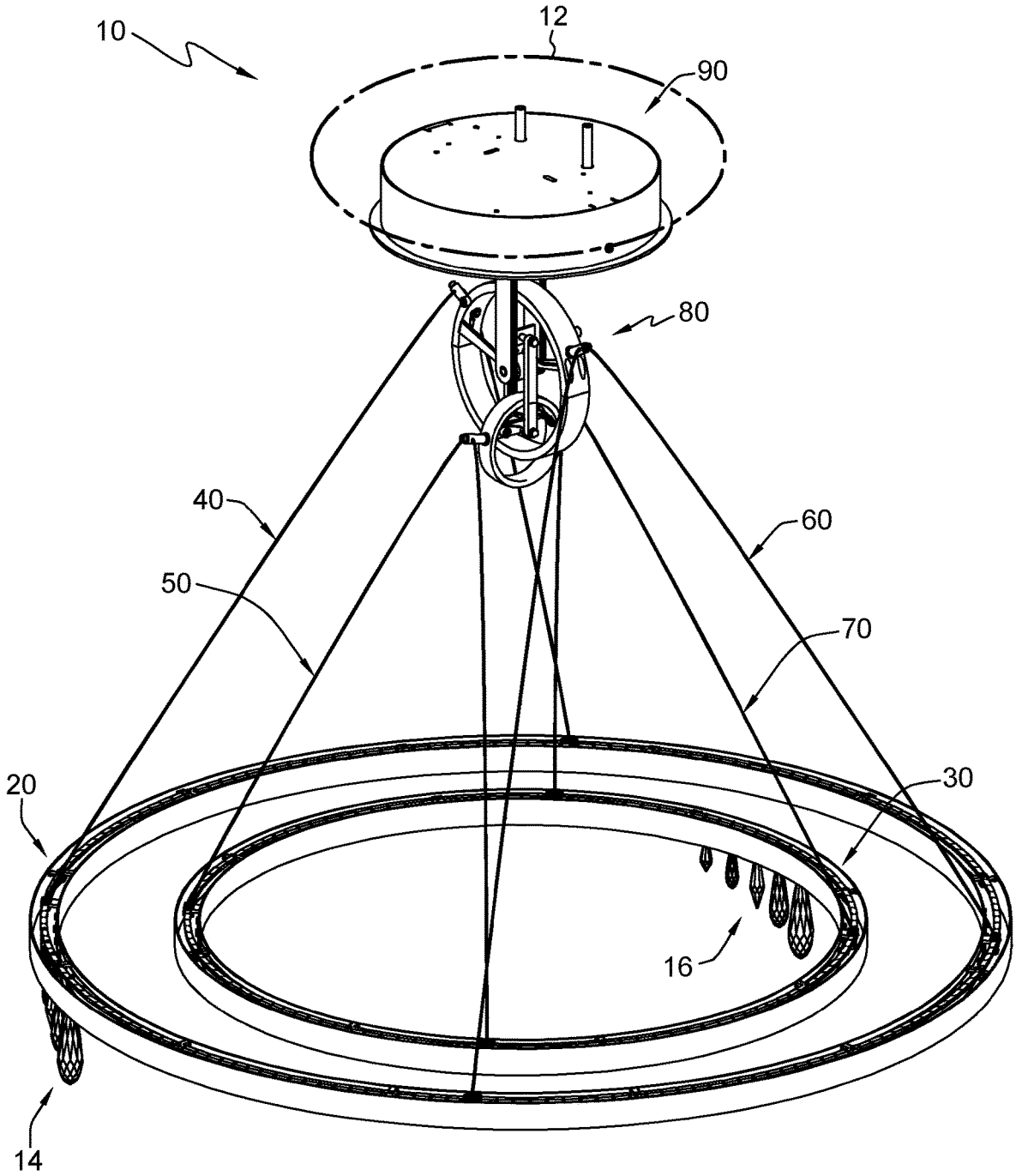
FIG. 1 is a top perspective view of a fixture such as a lighting fixture according to an embodiment of the present disclosure with the lighting fixture disposed in a first configuration.
Figure 2:
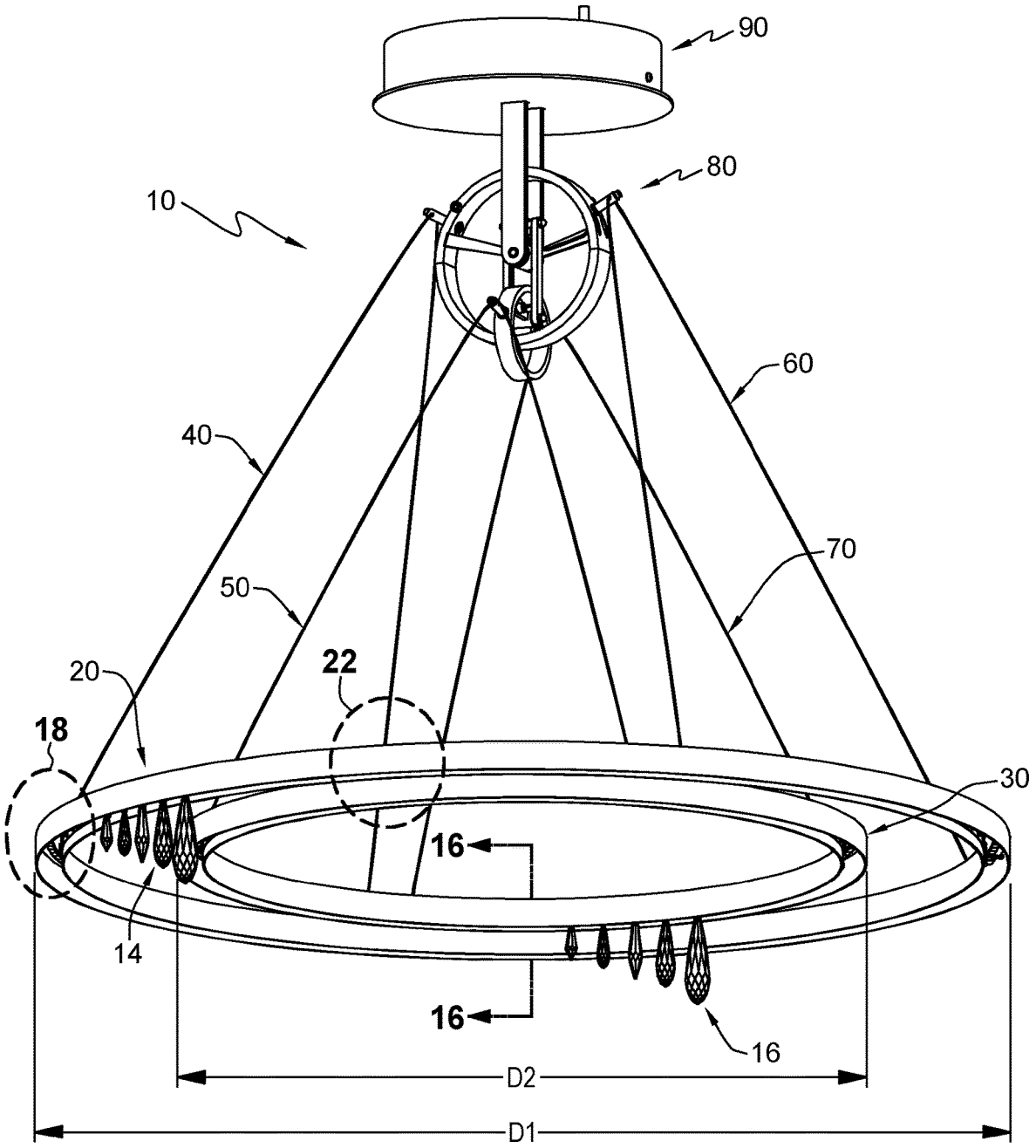
FIG. 2 is a bottom perspective view of the lighting fixture of FIG. 1.
Figure 3:
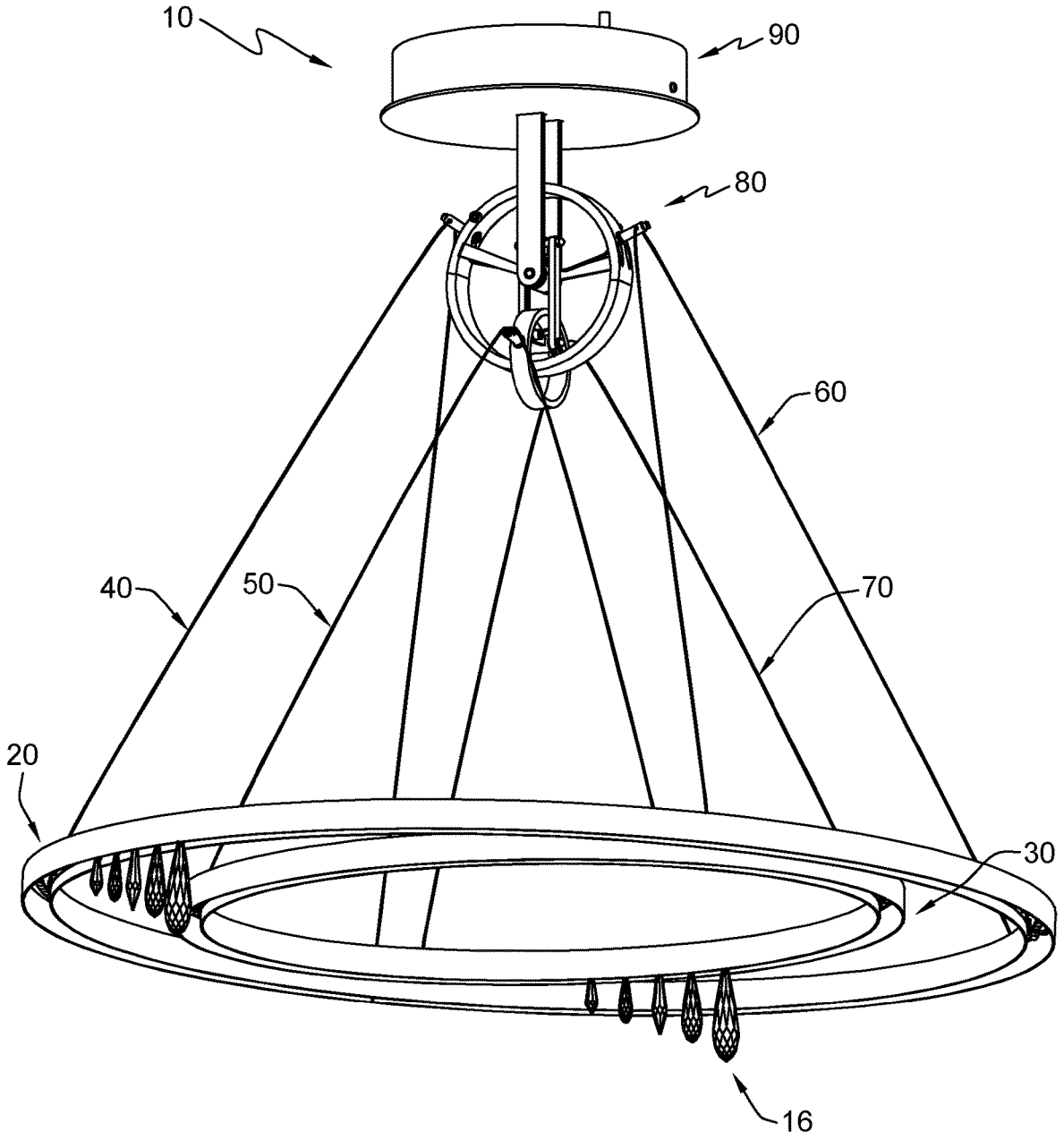
FIG. 3 is a bottom perspective view of the lighting fixture of FIG. 1 with the fixture disposed in a second configuration.

FIGS. 1 and 2 illustrate a fixture 10 such as a lighting fixture according to one embodiment of the present disclosure with lighting fixture 10 disposed in a first configuration. FIG. 3 illustrates lighting fixture 10 with lighting fixture 10 disposed in a second configuration, which may be one of many different configurations as described below. FIGS. 4-9 illustrate further views of lighting fixture 10.

With reference to FIGS. 1-3, in this illustrated embodiment, lighting fixture 10 may generally include a first lower support 20, a second lower support 30, an upper cord support 80, and a mounting escutcheon or canopy assembly 90. In this illustrated embodiment, first lower support 20 and second lower support 30 are suspended from upper cord support 80. For example, a first cord 40 and a second cord 60 may operably suspend first lower support 20 from upper cord support 80, and a third cord 50 and a fourth cord 70 may operably suspend second lower support 30 from upper cord support 80. In some embodiments, a plurality of ornaments 14 and 16 may be suspended from either or both of first lower support 20 and second lower support 40. The ornaments may be disposed in any pattern or arrangement along a portion of the entire length of the first and second lower supports. Canopy assembly 90 allows lighting fixture 10 to be mounted to a surface 12 (FIG. 1) such as a ceiling or overhang. Electrical power may typically be provided to canopy assembly 90 via an electrical wire or cable such as conventional 120 or 240 volt AC power from the local electrical grid, though one or more batteries may be located in canopy assembly 90.

In this illustrated embodiment, lower portions of first cord 40 and second cord 60 may be attached to first lower support 20 and upper middle portions of first cord 40 and second cord 60 may be attached to or operably supported from upper cord support 80. Lower portions of third cord 50 and fourth cord 70 may be attached to second lower support 30 and upper middle portions of third cord 50 and fourth cord 70 may be operably attached to or supported from upper cord support 80. As will be appreciated from the description below, adjusting upper cord support 80 allows independently adjusting and orienting lower support 20 and second lower support 30 relative to each other and relative to the ground. For example, upper cord support 80 may be operable to fixedly position and fixedly maintain first lower support 20 at different angles relative to the ground. In addition, upper cord support 80 may be operable to independently fixedly position and fixedly maintain second lower support 30 at different angles relative to the ground.

It will be appreciated that in other embodiments, separate cords having lower ends may be attached to lower supports and upper ends attached to upper cord supports. As described in greater detail below, in some embodiments, either or both of the first lower support and second lower support may include one or more light sources, for example, light-emitting diodes. In some embodiments, at least one or more of the plurality of cords may be a wire or include a wire adapted to transmit electrical power to the one or more light sources.

First lower support 20 and second lower support 30 may vary in outside dimension. As shown in FIG. 2, first lower support 20 may have an outside dimension D1, for example, a maximum lateral dimension, such as a width or diameter, and second lower support 30 may have an outside dimension D2, for example, a maximum lateral dimension, such as, a width or diameter. As illustrated in FIG. 2, maximum lateral dimension D2 of second lower support 20 may be smaller than maximum outside dimension D1 of first lower support 10. Lateral dimensions D1 and D2, for example, diameters, may typically range from about 50 millimeters to about 10 meters, but are typically between about 200 millimeters and 1 meters in outside dimension. For example, width or diameter D1 may range from about 2 meters to about 5 meters and the width or diameter D2 may range from about 2 meters to about 5 meters.

Figure 4:
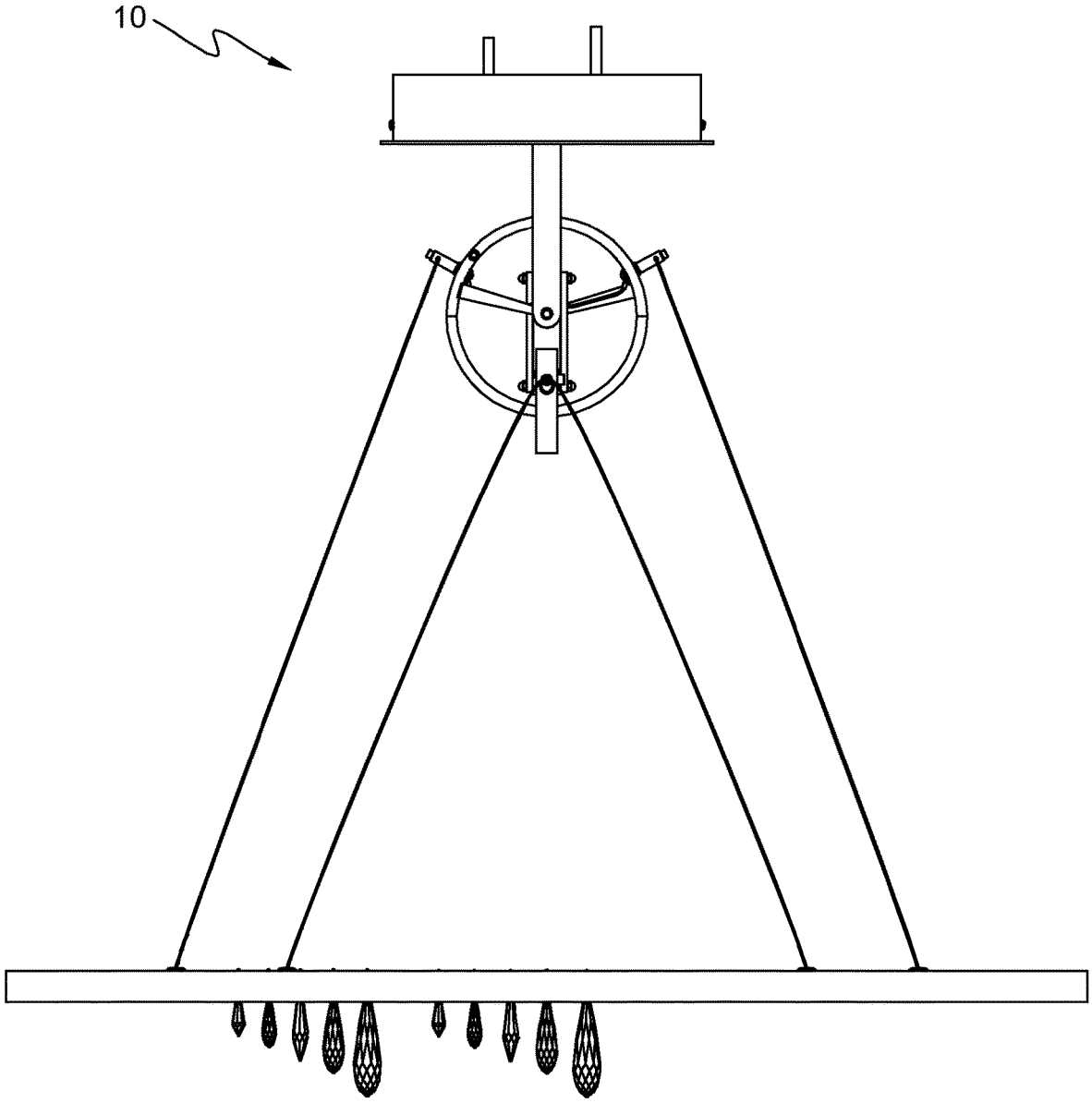
FIG. 4 is a front elevational view of the lighting fixture of FIG. 1.
Figure 5:
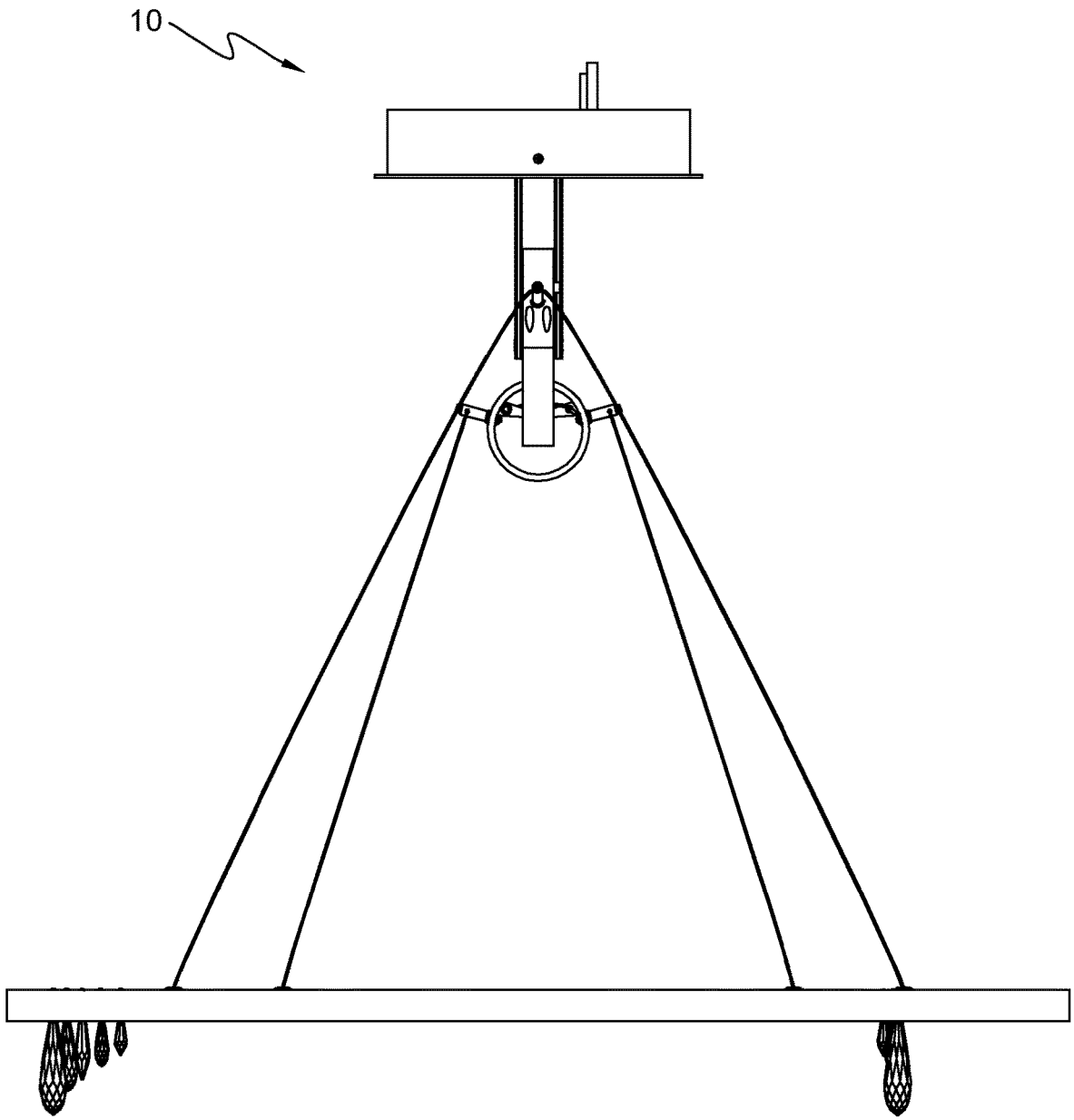
FIG. 5 is a right side elevational view of the lighting fixture of FIG. 1.
Figure 6:
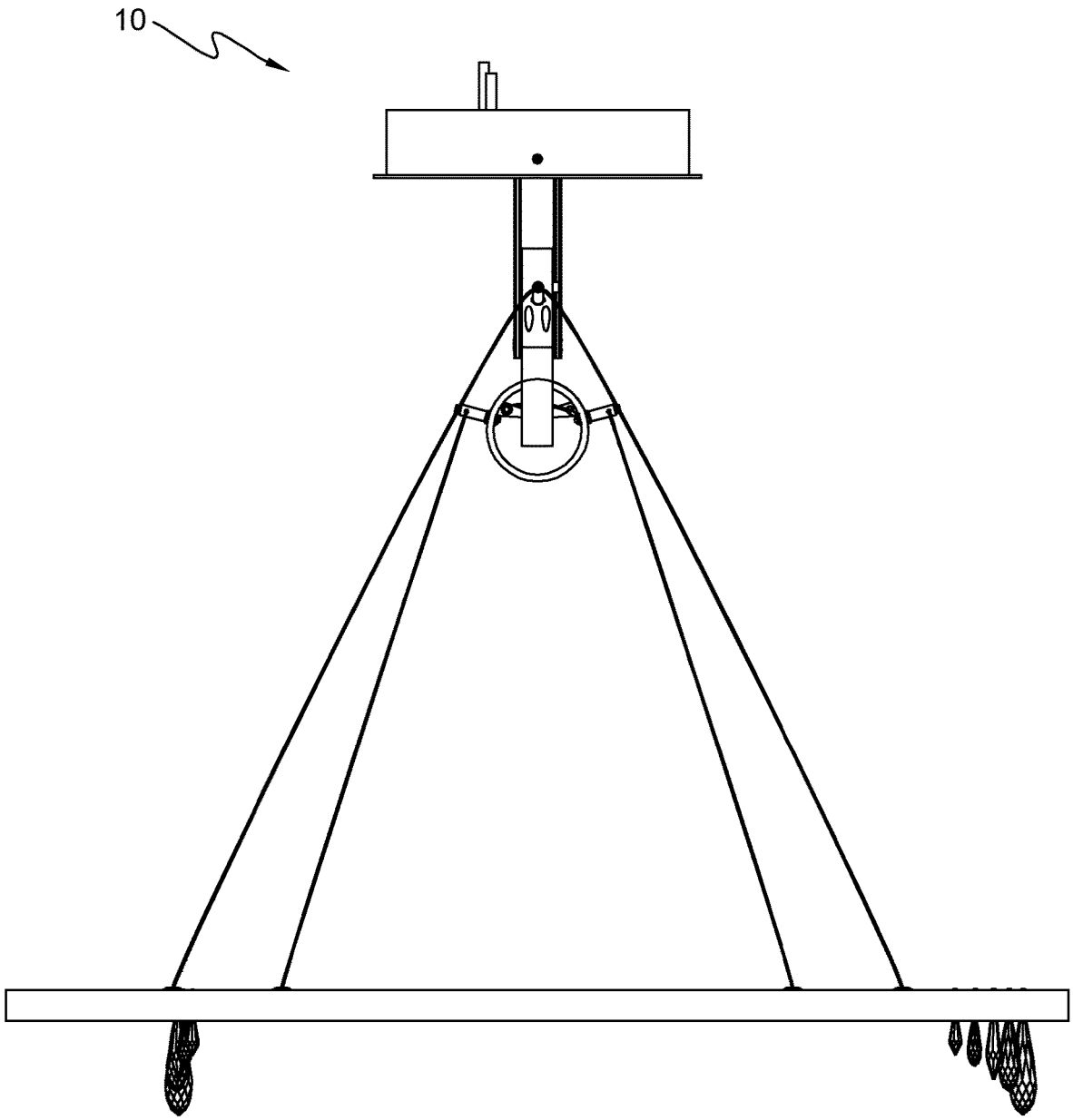
FIG. 6 is a left side elevational view of the lighting fixture of FIG. 1.
Figure 7:
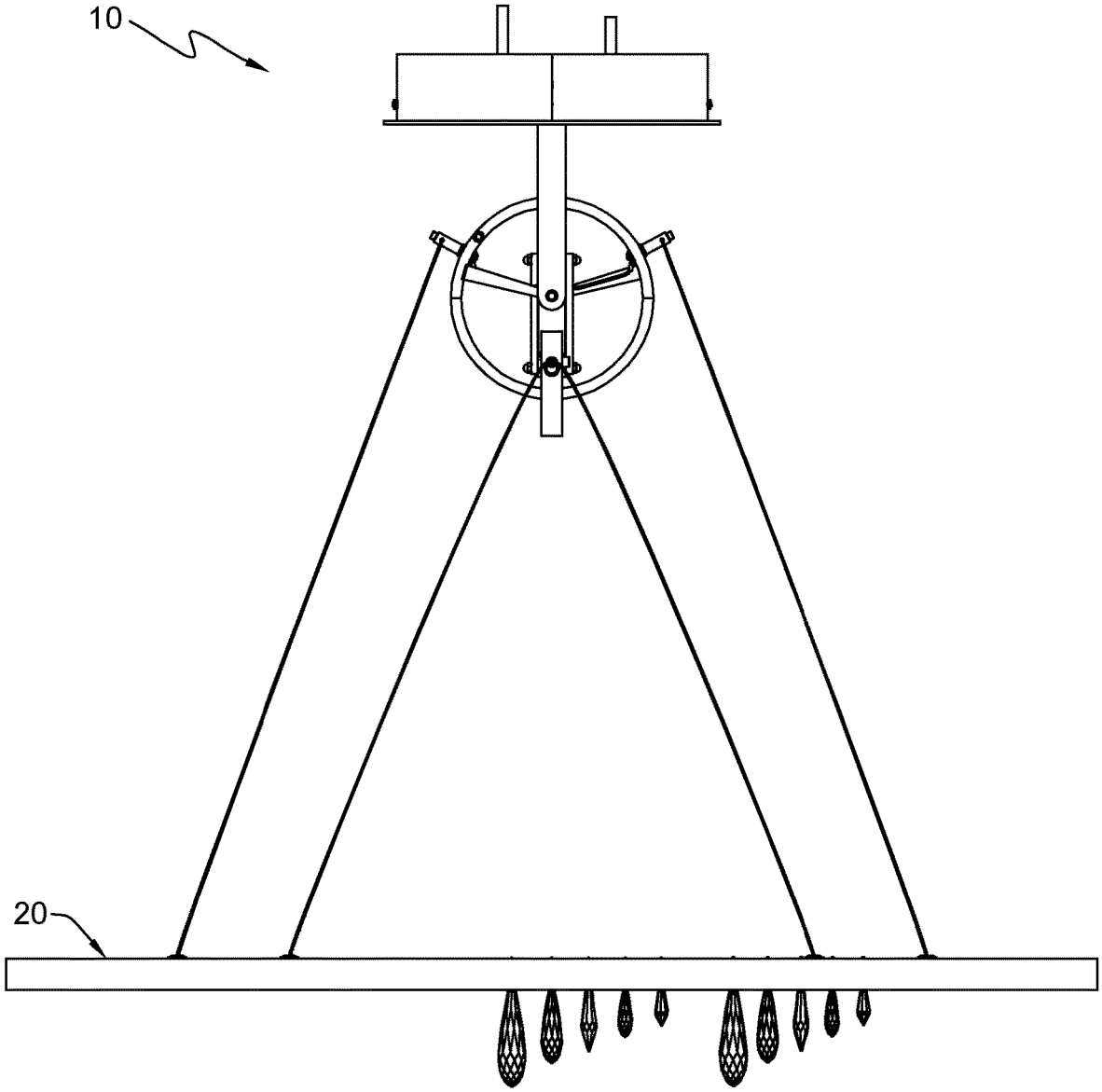
FIG. 7 is a rear elevational view of the lighting fixture of FIG. 1.
Figure 8:
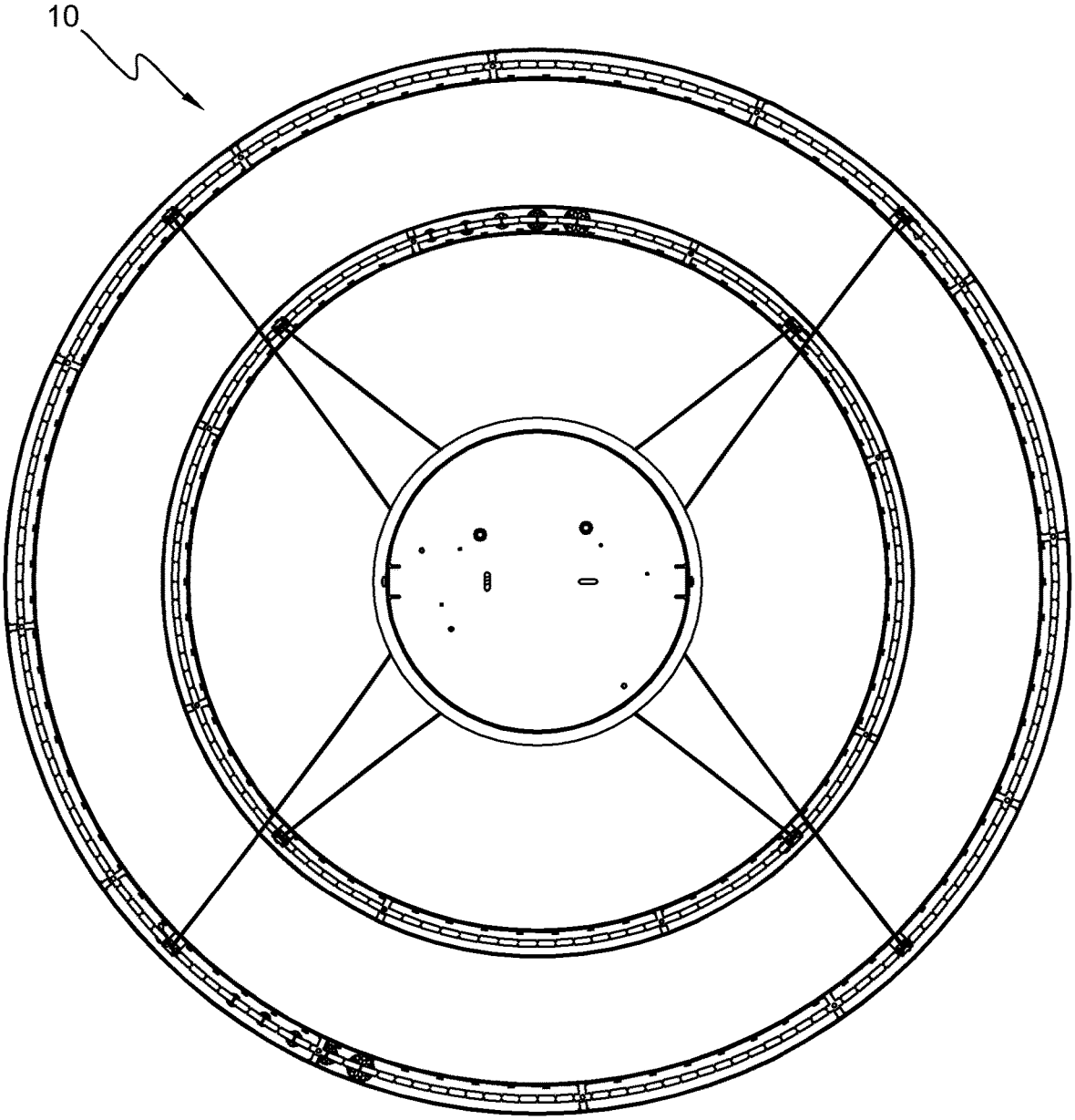
FIG. 8 is a top view of the lighting fixture of FIG. 1.
Figure 9:
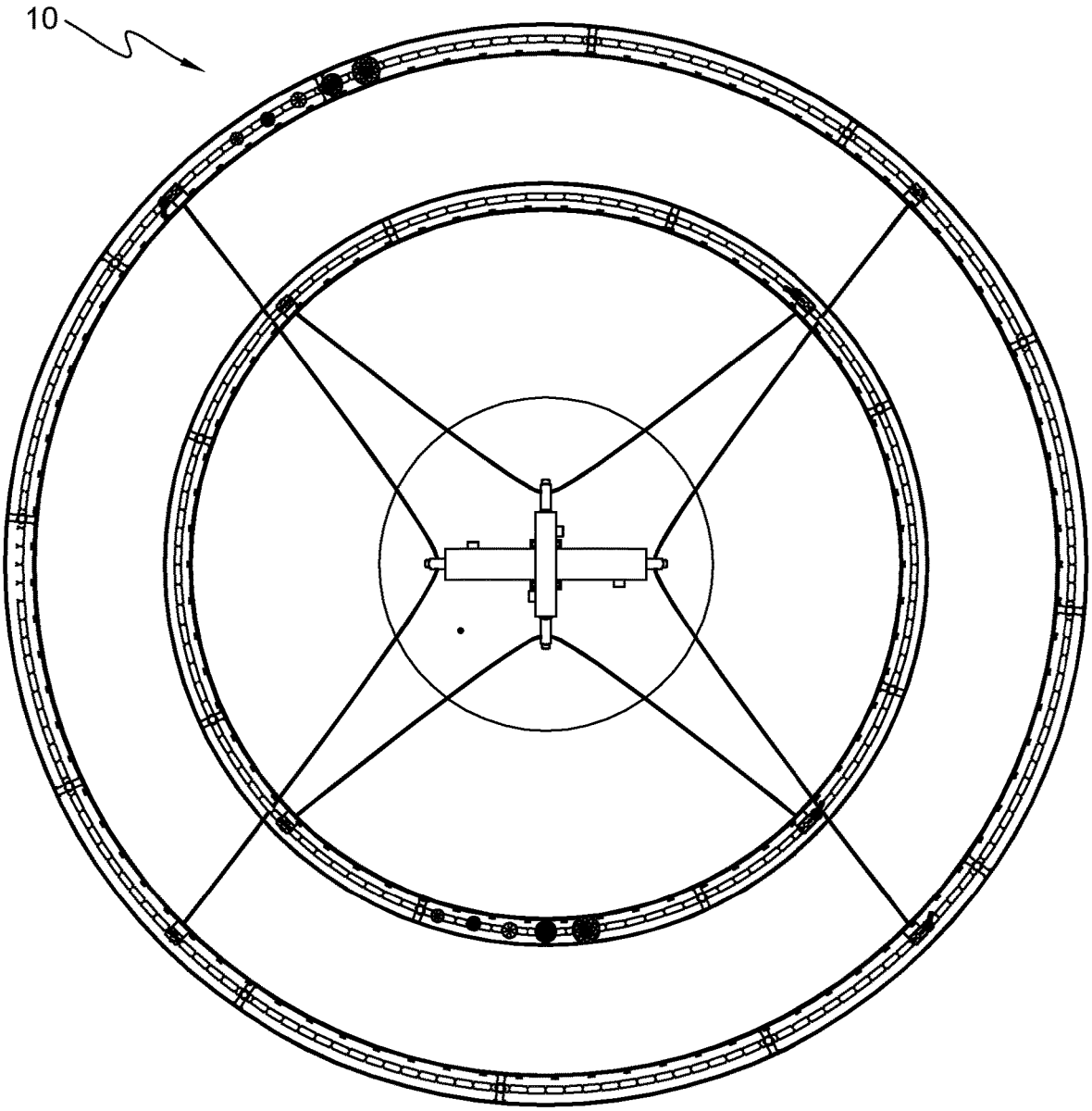
FIG. 9 is a bottom view of the lighting fixture of FIG. 1.
Figure 10:
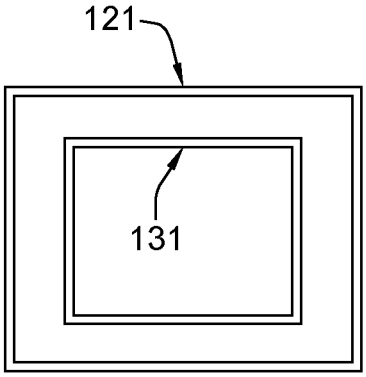
FIGS. 10-13 are top plan views, similar to FIG. 8, of lighting fixtures according to embodiments of the present disclosure.
Figure 11:
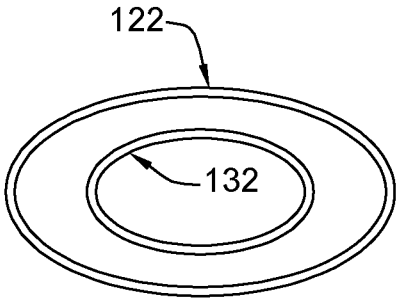
Figure 12:
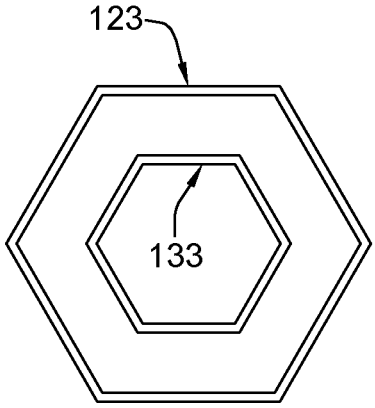

With reference to FIGS. 1, 3, and 4, lighting fixture 10 may be disposable in a configuration with first lower support 20 and second lower support 30 (FIGS. 1 and 2) alignable in a position or an orientation along a horizontal plane or relative to the ground. In other embodiments of a lighting fixture according to the present disclosure, first lower support and a second lower support may be disposable horizontally and separated or spaced apart by a vertical distance or dimension, for example, at different heights or elevations relative each other and to the ground. Other embodiments of lighting fixtures according to the present disclosure may include a single lower support. Further embodiments of lighting fixtures according to the present disclosure may include more than two lower supports.

Figure 13:
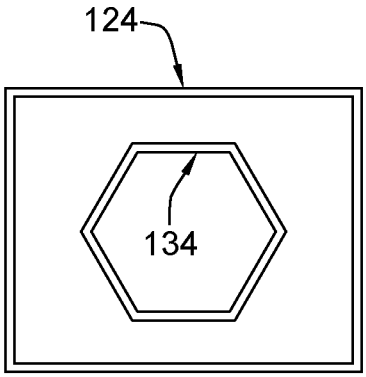

First lower support 20 and second lower support 30 may be in the form of a rings such as circular in shape such as a circular ring. However, first lower support 20 and second lower support 30 may have any geometric shapes according to embodiments of the present disclosure. For example, first and second lower support may be elliptical rings, polygonal rings, triangular rings, square rings, rectangular rings, pentagonal rings, hexagonal rings, octagonal rings, other polygonal ring shapes, or other shapes. FIGS. 10-13 are top plan views of first lower supports 121, 122, 123, and 124 and second lower supports 131, 132, 133, and 134 according to further embodiments of the present disclosure. As shown in FIG. 13, the lower supports may also vary in geometric shape, for example, first lower support 124 may be rectangular in shape and second lower support 134 may be hexagonal in shape. Other combinations of shapes for one, two, or more lower supports may be provided according to embodiments of the present disclosure.

Figure 14:
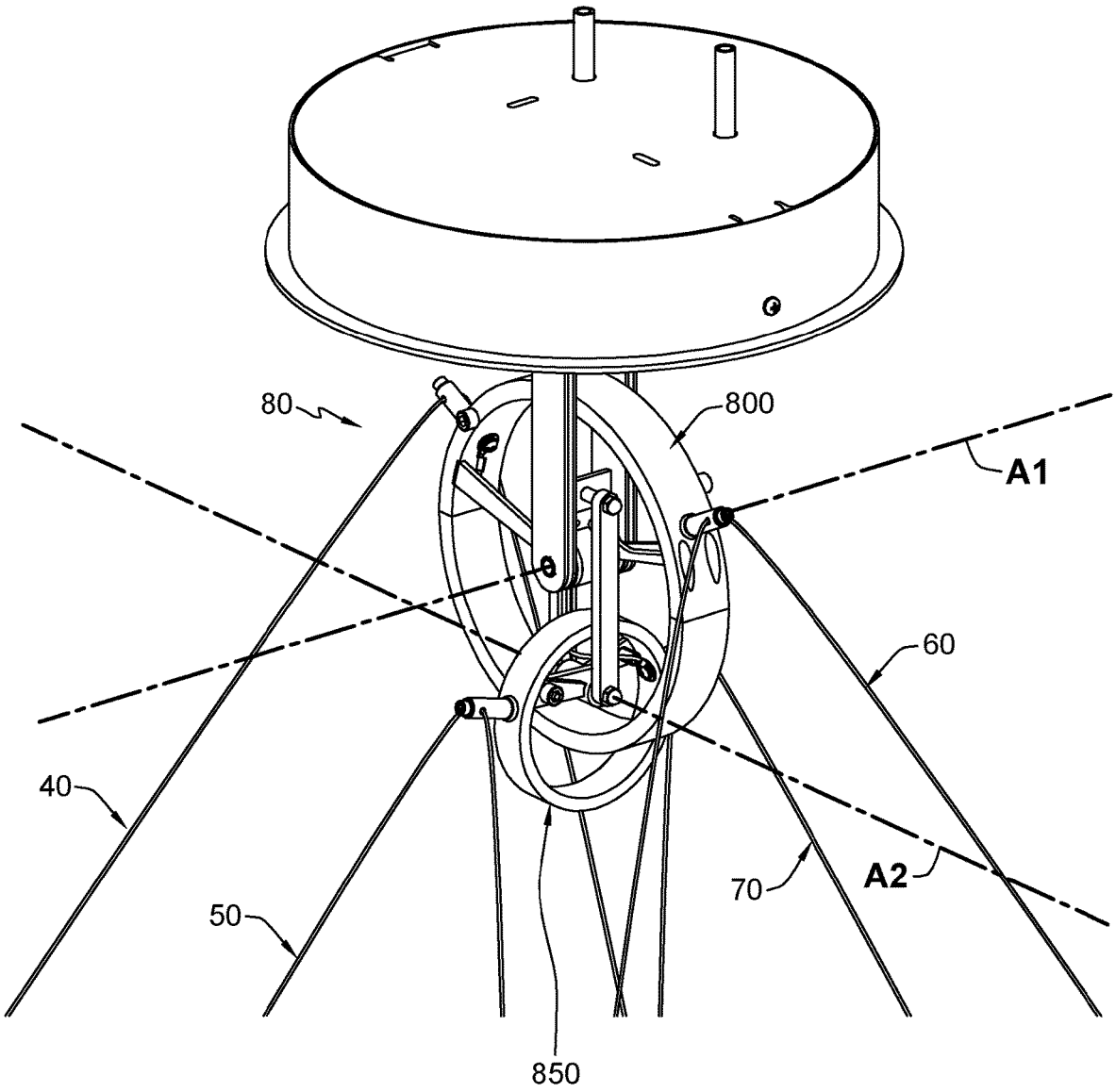
FIG. 14 is an enlarged perspective view of the upper cord support of the lighting fixture of FIG. 1.
Figure 15:
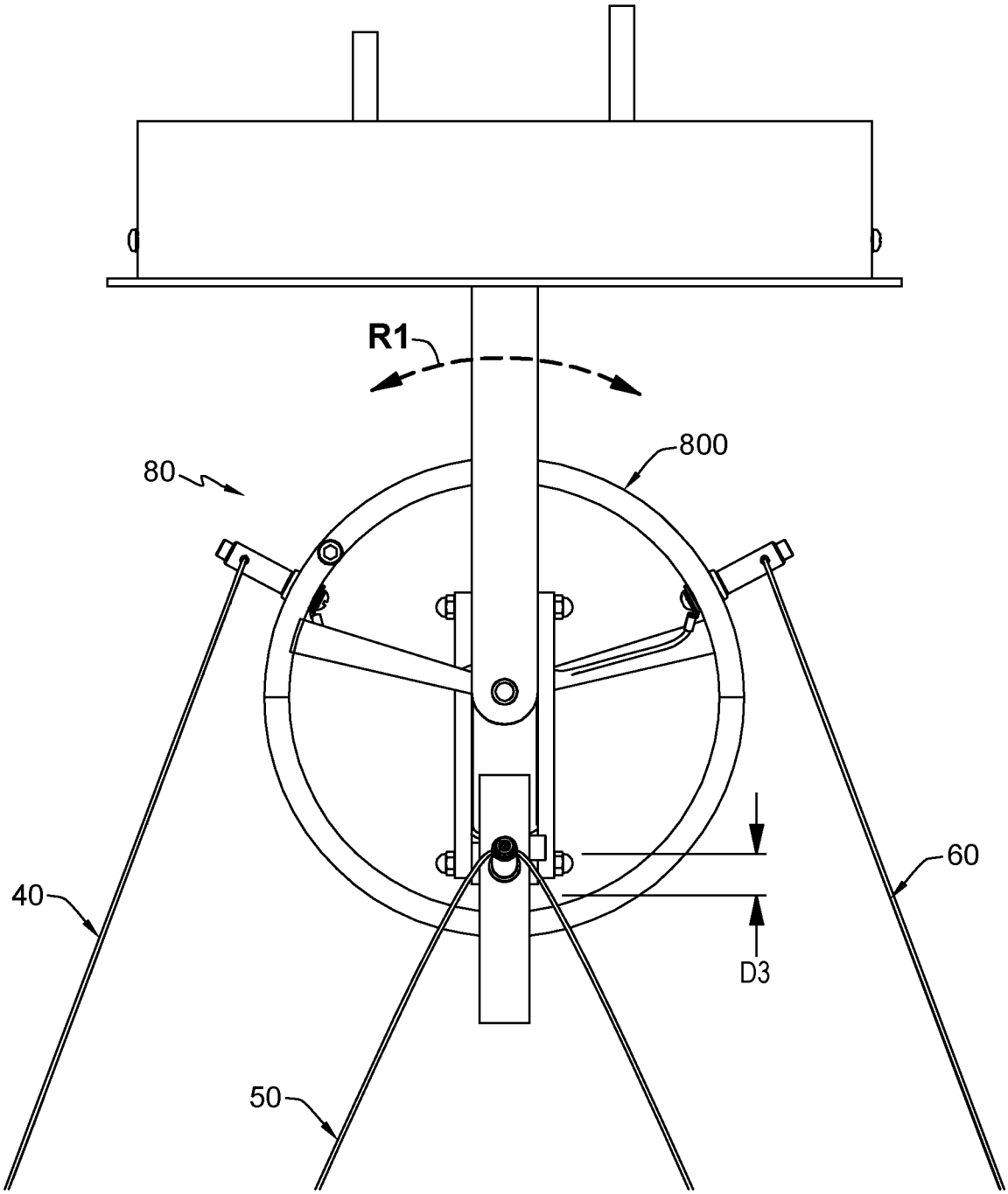
FIG. 15 is a front side elevational view of the upper cord support of FIG. 14.
Figure 16:
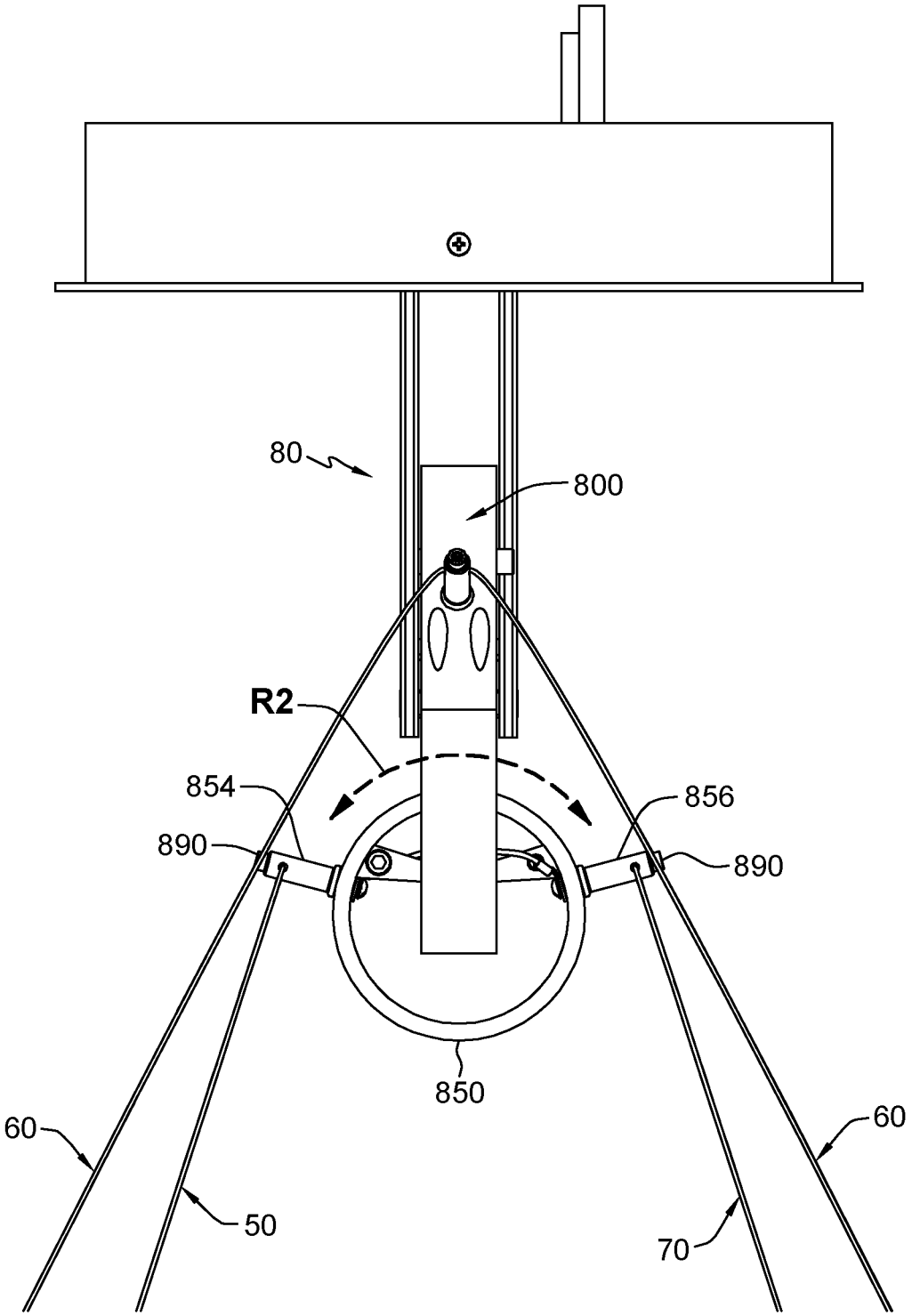
FIG. 16 is a right side elevational view of the upper cord support of FIG. 14.

With reference to FIGS. 14-16, upper cord support 80 may be operable to fixedly maintain upper portions of first cord 40 (FIGS. 14 and 15) and second cord 60 over a range of different positions so that first lower support 20 (FIGS. 1 and 3) may be fixedly maintained over a range of different angles or orientations relative to the ground. Upper cord support 80 may be operable to fixedly maintain upper portions of third cord 50 and fourth cord 70 (FIGS. 14 and 16) over a range of different positions so that second lower support 30 (FIGS. 1 and 3) may be fixedly maintained over a rage of different angles or orientations relative to the ground.

In this illustrated embodiment, upper cord support 80 may include a first rotatable member 800 rotatable about a first axis A1 (FIG. 14) in the directions of curved double arrow R1 (FIG. 15), and a second rotatable member 850 rotatable about a second axis A2 (FIG. 14) in the directions of curved double arrow R2 (FIG. 16). First rotatable member 800 is operable to adjustably move upper portions of first cord 40 (FIGS. 14 and 15) and upper portions of second cord 60 about axis A1 (FIG. 14), and second rotatable member 850 is operable to adjustably move upper portions of third cord 50 and upper portions of fourth cord 70 (FIGS. 14 and 16) about axis A2 (FIG. 14).

Figure 17:
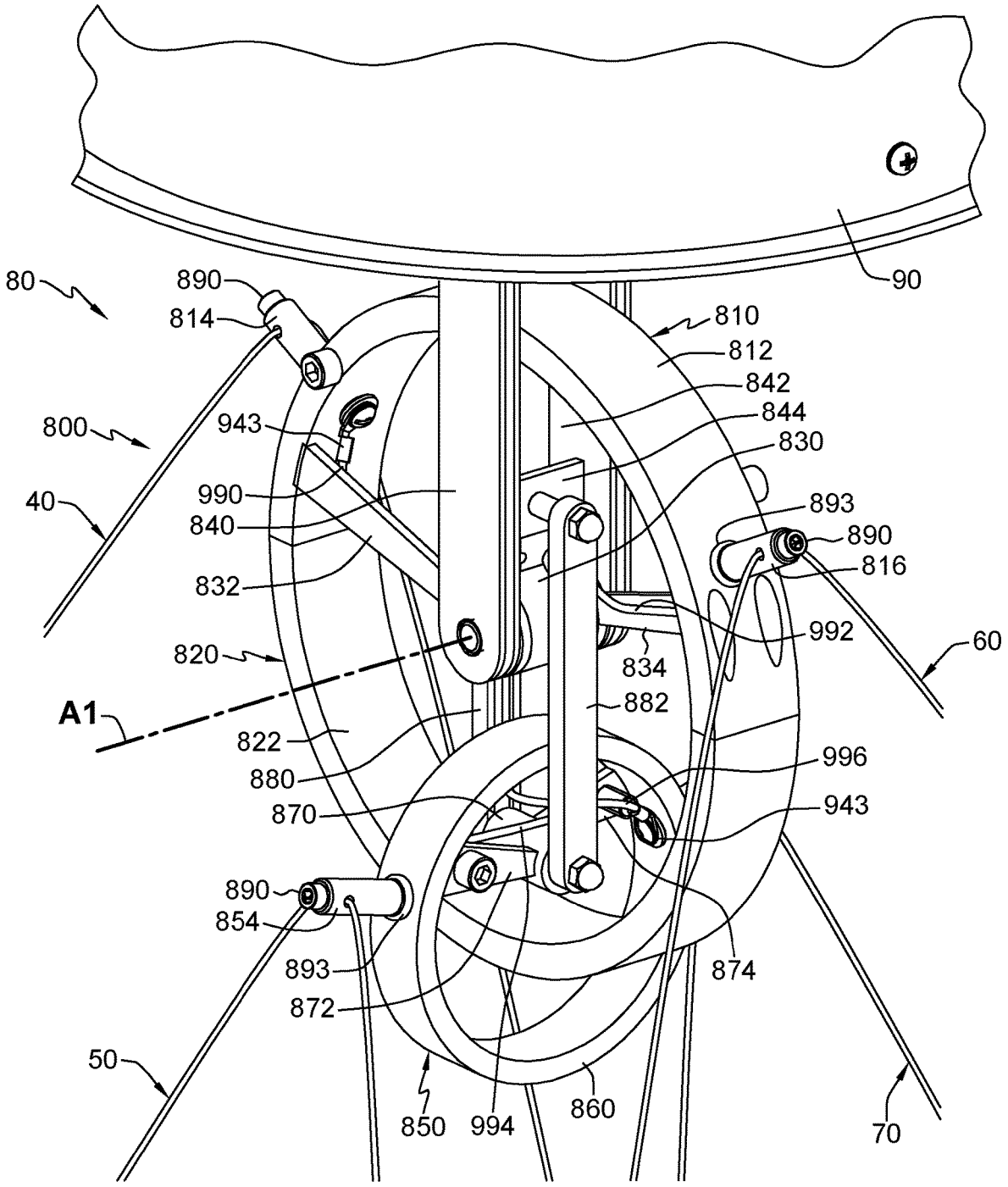
FIG. 17 is an enlarged perspective view of the upper cord support of FIG. 14.

As best shown in FIG. 17, first rotatable member 800 may be a rotatable ring member formed from an upper semicircular portion 810 having a semicircular member 812 and a lower semicircular portion 820 having a semicircular member 822. Upper semicircular portion 810 may include a hub 830 and a pair of radial arms 832 and 834 extending between hub 830 and upper semicircular member 812. Radial arms 832 and radial arm 834 may be offset relative to axis A1, e.g., radial arm 832 disposed on one side of first rotatable member 800 and radial arm 834 may be disposed on the other side of first rotatable member 800. A pair of vertical legs 840 and 842 may extend from canopy assembly 90 and pivotally attached to hub 830 via a pin or a bolt.

Second rotatable member 850 may be a rotatable ring 860 having a hub 870 and a pair of radial arms 872 and 874 extending between hub 870 and rotatable ring 860. A pair of vertical legs 880 and 882 may include upper end portions attached to a cross-bar 844 extending between vertical legs 840 and 842, and lower end portions pivotally attached to hub 870 via a pin or a bolt. Second rotatable ring 850 may extend around first rotatable member 810, e.g. lower semicircular portion 820 may be placed in second rotatable ring 850 and thereafter upper semicircular portion 810 may be operably connected to lower semicircular portion 820 such as by welding, bolts, or via other suitable attachment.

The rotatable axis of first rotatable member 800 may be of offset from the center of first rotatable member 800. For example, hub 830 may be disposed closer to upper semicircular portion 810 than to lower semicircular portion 820. The rotatable axis of second rotatable member 850 may be of offset from the center of second rotatable member 850. For example, hub 870 may be disposed closer to an upper semicircular portion of second rotatable member 850 than to a lower semicircular portion of second rotatable member 850 (e.g., offset a distance D3 as best shown in FIG. 15). Offsetting the rotational axis of the rotatable member may reduce the torque needed to change the configuration of the lighting fixture and the resistance needed in maintaining the upper cord support and the lower supports in a fixed position once moved or repositioned.

First rotatable member 800 and second rotatable member 850 may be configured so that repositioning or rotating first rotatable member 800 and second rotatable member 850 by a user may be result in first rotatable member 800 and second rotatable member 850 being fixedly maintained in a repositioned configuration or orientation and operable to support the first and second lower supports in repositioned angles or orientation resulting in the lighting fixture having a range of different configurations once let go by the user and without user contact of the light fixture. For example, hubs 830 and 870 may be suitably frictionally connected to the vertical legs so as to prevent or inhibit rotation once repositioned as described in greater detail below.

First rotatable member 800 may include a first projection 814 for supporting an upper portion of first cord 40 and a second projection 816 for supporting an upper portion of second cord 60. Second rotatable member 850 may include a third projection 854 (FIGS. 16 and 17) for supporting an upper portion of third cord 50 and a fourth projection 856 (FIGS. 16 and 17) for supporting an upper portion of fourth cord 70. For example, threaded set screws 890 (FIGS. 16 and 17) may operable attach to the distal end of the projections. In this illustrated embodiment, middle portions of the cords may be supported in an aperture or hole extending through the projections and engageable with the set screws. The projections may be electrically isolated from the first rotatable member 800 and second rotatable member 850. For example, the projections may be supported on an insulator or grommet 893. The proximal end of the projections may be attached to the rotatable member with screws. As described below, electrical wires for providing power to the cords may be operably connected to the screws, which screws are operably electrically connected to the projections.

Figure 18:
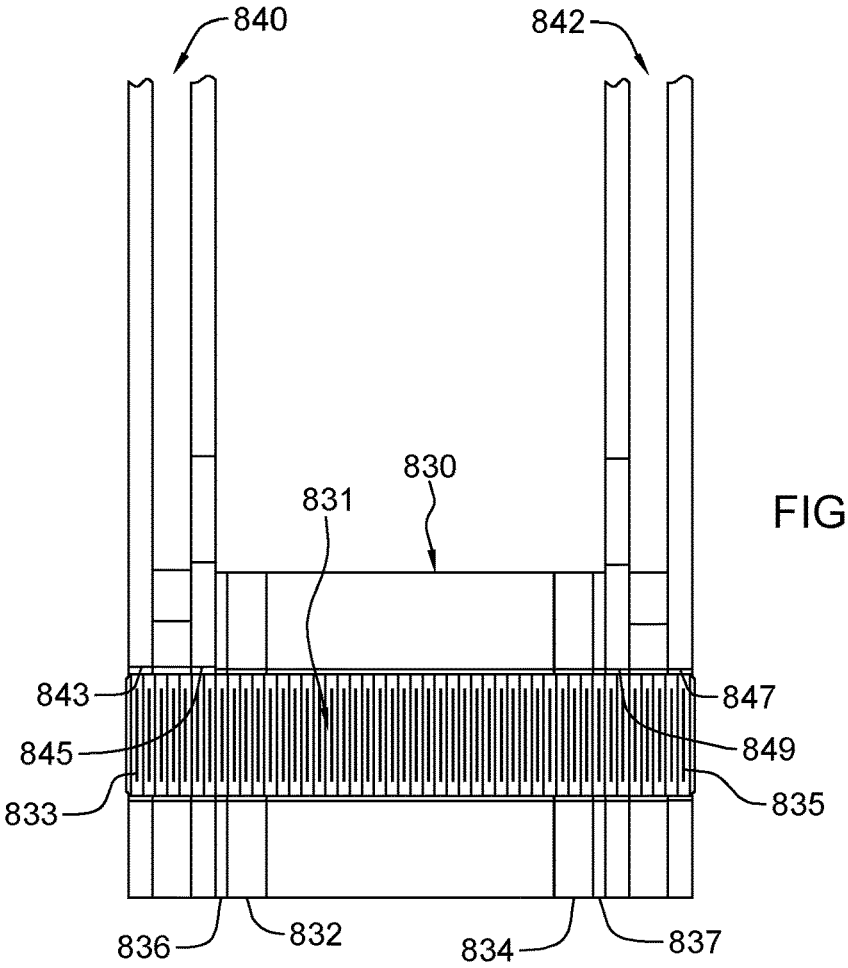
FIG. 18 is an enlarged cross-sectional view of the hub and the vertical legs of the first rotatable member of the upper cord support of FIG. 17.

FIG. 18 illustrates hub 830 and vertical legs 840 and 842 of first rotatable member 800 (FIG. 17) of upper cord support 80 (FIG. 17). Hub 830 may be suitably frictionally connected to vertical legs 840 and 842 so as to allow a user to rotate first rotatable member 800 (FIG. 17) and to prevent or inhibit rotation of first rotatable member 810 (FIG. 17)

and maintain first rotatable member 800 (FIG. 17) in position after being rotated, positioned, or repositioned by a user to maintain first support lower support 20 (FIG. 1) in a fixed position without user intervention. For example, a threaded pin 831 may include a first threaded end 833 threadably attachable to a threaded holes 843 and 845 in vertical leg 840, and a second threaded end 835 extendable through a threaded holes 847 and 849 in vertical leg 842. Sandwiched between vertical legs 840 and 842 may be a resilient washer 836, radial arm 832, hub 830, radial arm 834, and resilient washer 837.

The assembly of vertical leg 840, a resilient washer 836, radial arm 832, hub 830, radial arm 834, resilient washer 837, and vertical leg 842 may be clamped together prior to installing threaded pin 831. For example, once clamped together and once threaded pin 831 is threadably installed and connected to vertical legs 840 and 842, mattingly-engaging contacting surfaces of vertical leg 840, resilient washer 836, radial arm 832, hub 830, radial arm 834, and resilient washer 837, and vertical leg 842 are frictionally engaged. An operable compressive force may be maintained on the assembly of vertical leg 840, resilient washer 836, radial arm 832, hub 830, radial arm 834, and resilient washer 837, vertical leg 842, and pin 831 so that a user is operable to rotate first rotatable member 800 (FIG. 17) and prevent or inhibit rotation of first rotatable member 810 (FIG. 17) and maintain first rotatable member 800 (FIG. 17) in position after being rotated, positioned, or repositioned by a user to maintain first support lower support 20 (FIG. 1) in a fixed position without user intervention.

Figure 19:
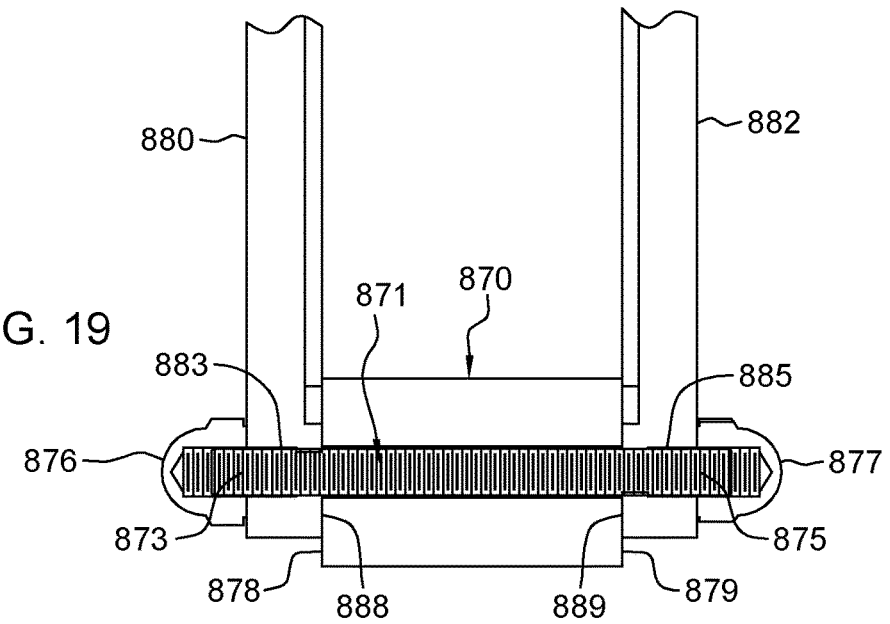
FIG. 19 is an enlarged cross-sectional view of the hub and the vertical legs of the second rotatable member of the upper cord support of FIG. 17.

FIG. 19 illustrates hub 870 and vertical legs 880 and 882 of second rotatable member 850 (FIG. 17) of upper cord support 80 (FIG. 17). Hub 870 may be suitably frictionally connected to vertical legs 880 and 882 so as to allow a user to rotate second rotatable member 850 (FIG. 17) and to prevent or inhibit rotation of second rotatable member 850 (FIG. 17) and maintain second rotatable member 850 (FIG. 17) in position after being rotated, positioned, or repositioned by a user to maintain second support lower support 30 (FIG. 1) in a fixed position without user intervention. For example, a threaded pin 871 may include a first threaded end 873 extendable through a hole 883 in vertical leg 880, and a second threaded end 875 extendable through a through hole 885 in vertical leg 882. An acorn hex cap 876 may be threadably attached to first threaded end 873 of threaded pin 871. An acorn hex cap 877 may be threadably attached to second threaded end 875 of threaded pin 871. Suitably tightening acorn hex caps 876 and 877 causes end surfaces 878 and 879 of hub 870 to frictionally engage side surfaces 888 and 889 of vertical legs 880 and 882, respectively.

It will be appreciated that other suitable pins, nuts, washers, clamping means, adjustable engaging portions or means, etc. may be employed to frictionally attach and secure a rotatable member to the vertical legs to allow a user to rotate a rotatable member and to prevent or inhibit rotation of the first rotatable member and maintain the first rotatable member in position after being rotated, positioned, or repositioned by a user to maintain support lower support in a fixed position without user intervention. Other suitable restraining means or adjustable locking means may be employed to allow user to rotate a first rotatable member and thereafter maintain the first rotatable member in a fixed position to maintain support lower support in a fixed position. A user may adjust the position and orientation of the lower supports by physically grasping and moving the rotatable members. Alternatively, a user may physically grasp and move a lower support by using the lower support to apply tension on the support cords which tensioned support cords are operable to apply a rotating force on the rotatable member to reposition the lower support. The various components of the upper cord support may be fabricated from metal such as steel and powder coated. The resilient washes may be fabricated from a plastic material such as a thermoplastic polymers, e.g., LEXAN Polycarbonate material. It will be appreciated that other materials may be suitably employed.

Figure 20:
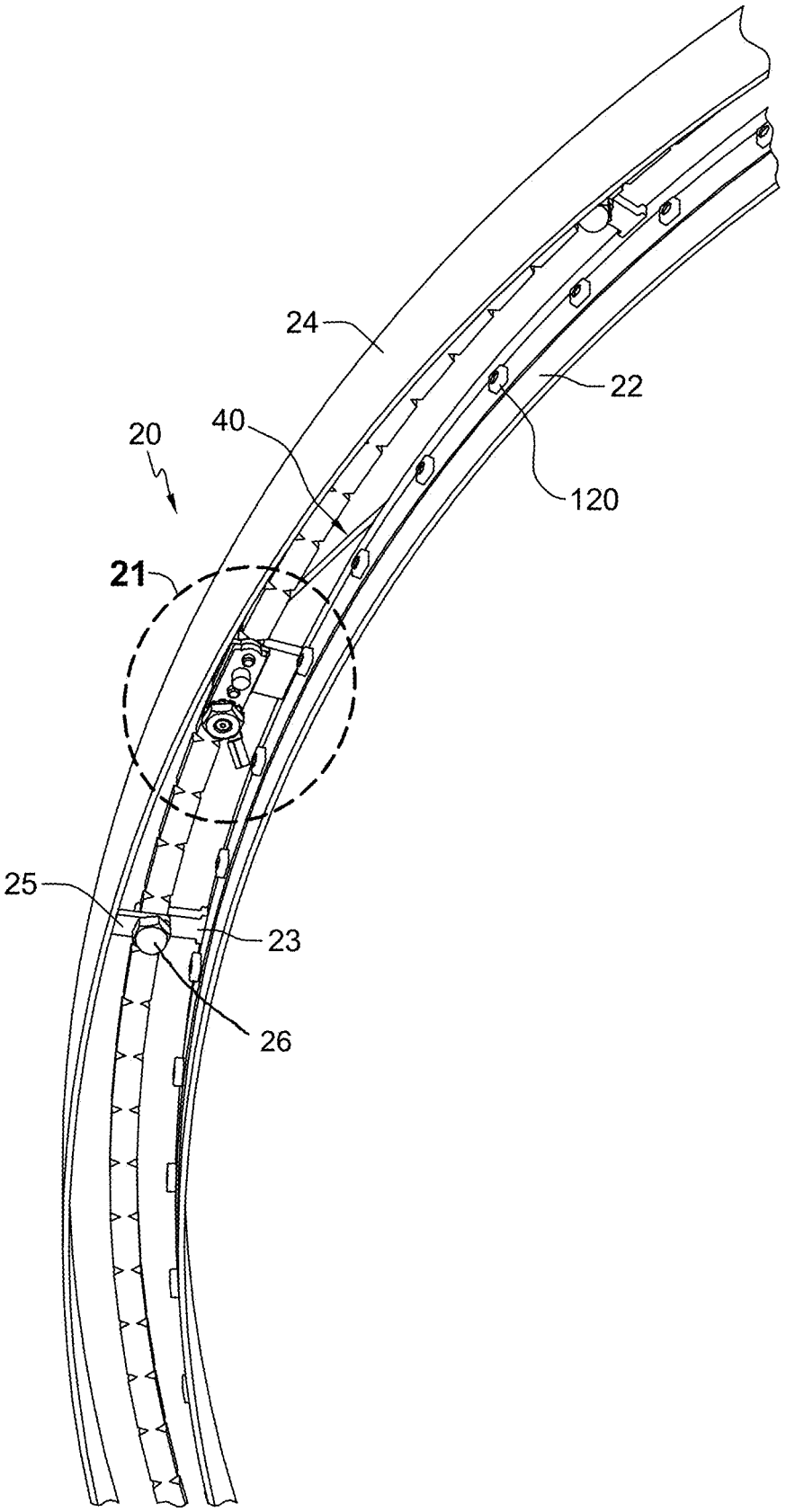
FIG. 20 is an enlarged bottom perspective view of Detail 18 of the lighting fixture of FIG. 2 with the light sources.

FIGS. 20-23 illustrate the configuration of the lower supports and attachment of the cords to the lower supports. For example, FIG. 20 illustrates a portion of first lower support 20. First lower support 20 may include hollow rings having an inner wall 22 and an outer wall 24. Inner wall 22 and outer wall 24 may be joined or coupled by any conventional means such as mechanical fasteners or welding. For example, inner wall 22 and outer wall 24 may be joined by a plurality of mounting plates 23 mounted on inner wall 22 and a plurality of overlapping mounting plates 25 mounted on outer wall 24, which plates are connected together by a plurality of mechanical fasteners 26. Mounting plates 23 and 25 may be mounted on inner wall 22 and outer wall 24, respectively, by welding or brazing. In other embodiments, first and second lower supports may include a top wall or plate and/or a bottom wall or plate. A top wall and/or bottom wall may completely encircle or cover the inner and outer walls, or may intermittently cover the inner or outer walls, for example, providing a plurality of openings or gaps between individual sections of a top wall and/or a bottom wall. Inner wall 22, outer wall 24 (and top wall and bottom wall if provided) may be opaque, translucent, or transparent. For example, inner wall 22 and outer wall 24 may be opaque, for example, being a thin gauge sheet metal, though plastics may be used.

Figure 21:
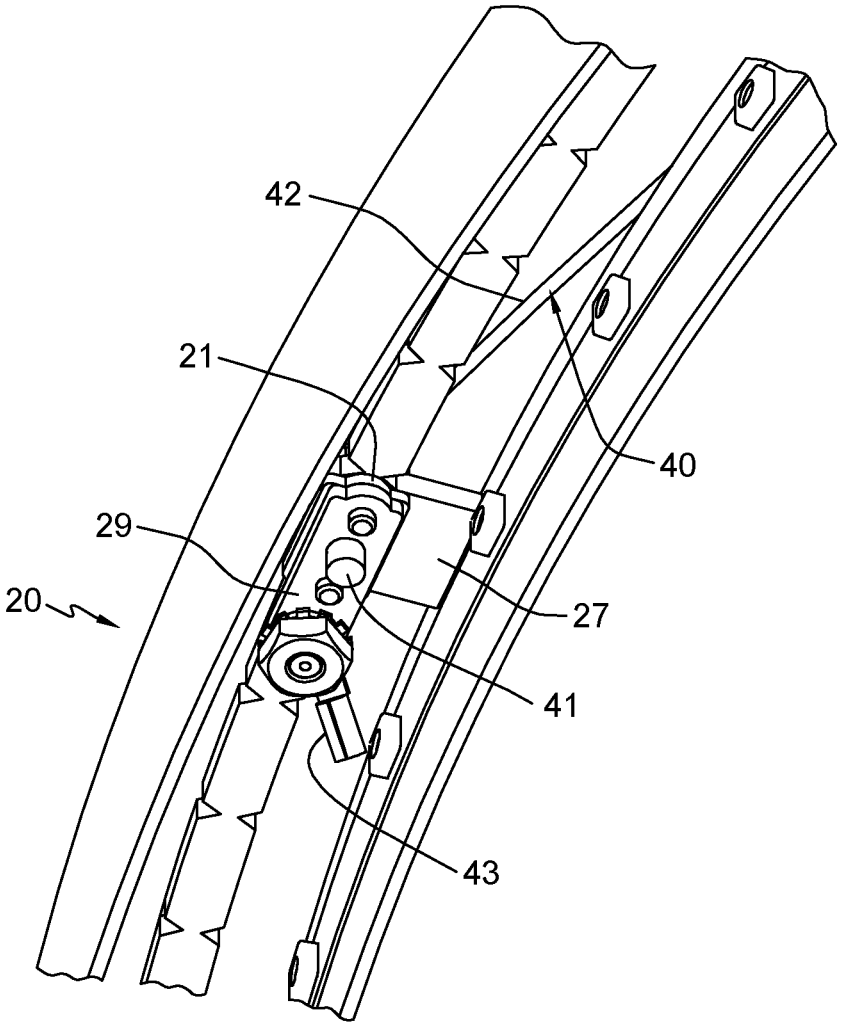
FIG. 21 is an enlarged view of Detail 21 of FIG. 20.

FIG. 21 illustrates the attachment of one end of first cord 40 to lower support 20. For example, first cord 40 may include an end 42 having an enlarged plug end or cable end 41. A mounting plate 27 may extending from inner wall 22 of lower support 20. Disposed on the top and bottom of mounting bracket 27 may be upper and lower insulating pads 21 (only one of which is shown). Disposed on the lower insulating pad 21 may be a metal bracket 29. Metal bracket 29, insulating pads 21, and mounting bracket 27 may be connected with bolts or rivets and may include aligned apertures (not shown in FIG. 21) therein sized for receiving cord 40, e.g., sized larger than the diameter of first cord 40 but sized less than enlarged cable end 41. Where cord 40 is operable to carry electrical power to, for example, light sources in the lower support, a metal electrical eyelet terminal 43 may be operably attached to metal bracket 29.

Figure 22:
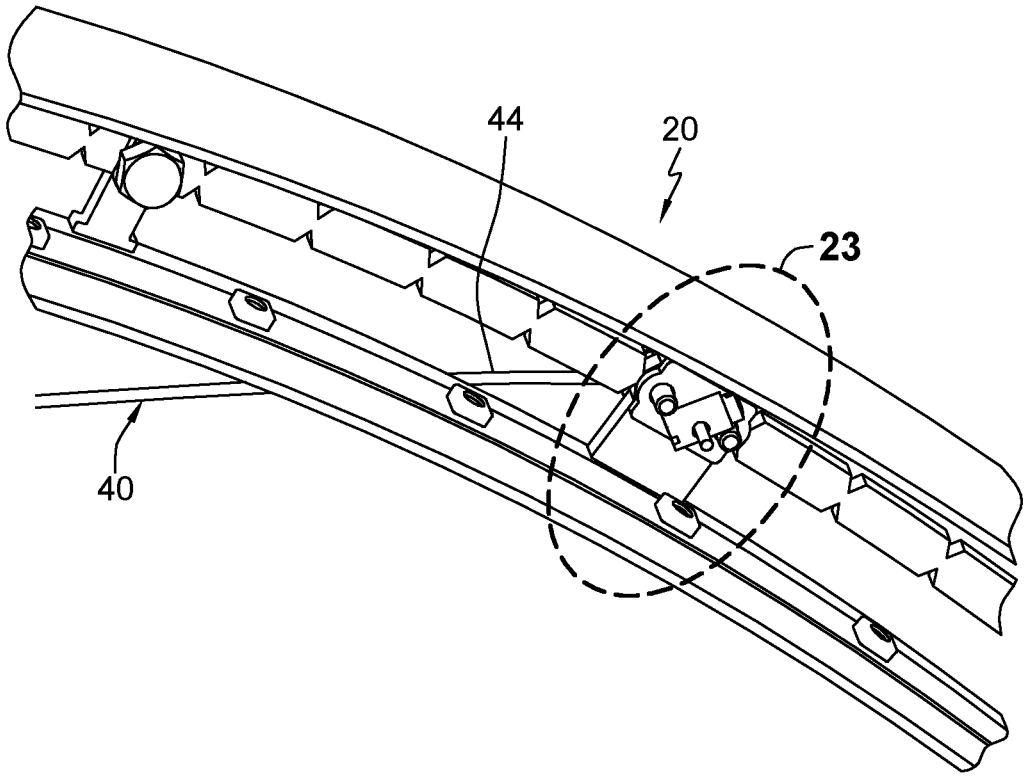
FIG. 22 is an enlarged bottom perspective view of Detail 22 of the lighting fixture of FIG. 2.
Figure 23:
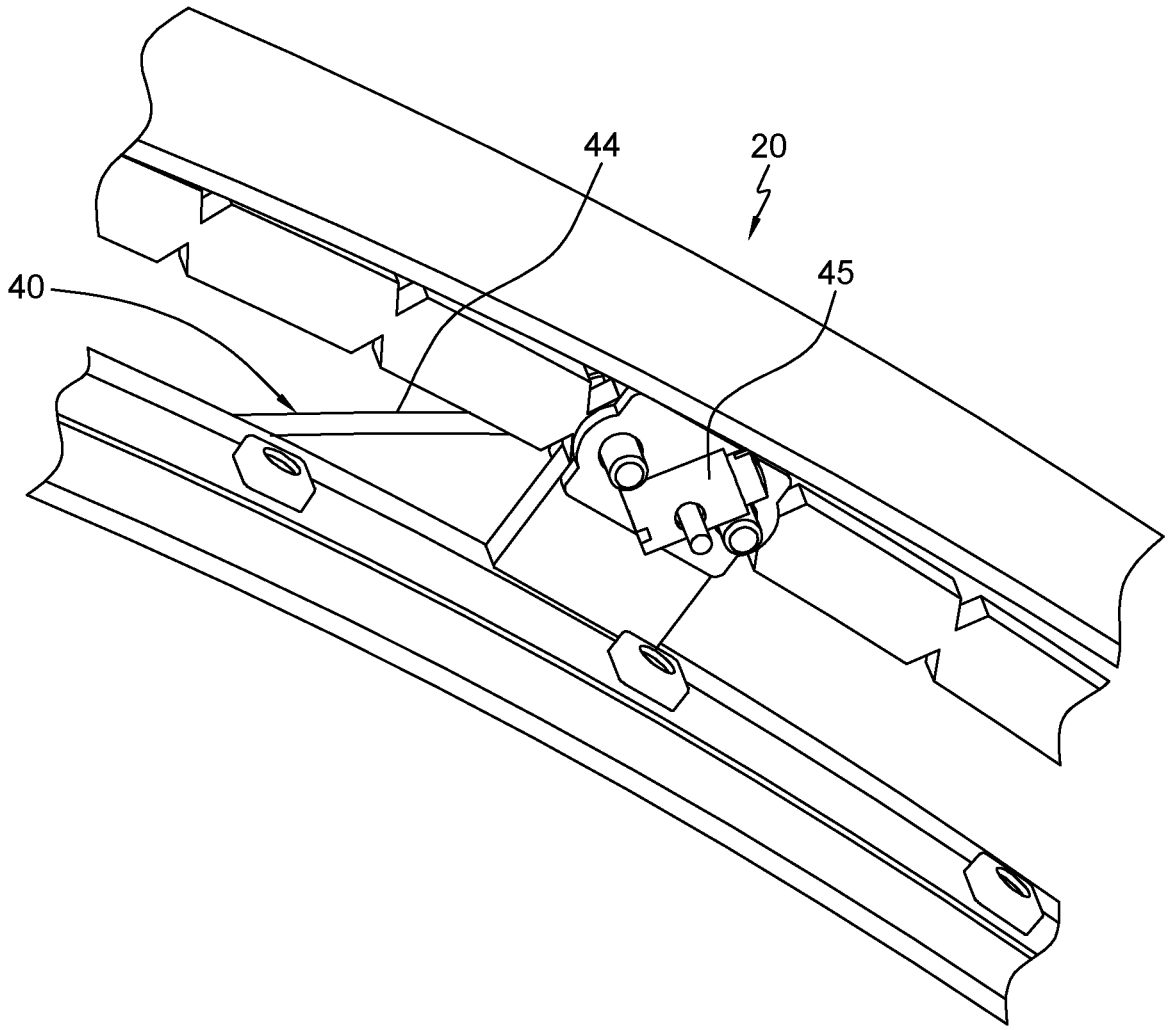
FIG. 23 is an enlarged view of Detail 23 of FIG. 22.

FIGS. 22 and 23 illustrate an adjustable attachment of the other end 44 of first cord 40 to lower support 20. End 44 of first cord 40 may extend through apertures in a mounting plate and upper and lower insulating pads similar to as describe in connection with FIG. 21. For example, the length of cord 40 may be adjustable, and thus the distance between the upper cord support and the lower support (e.g., height of the fixture) is adjustable. As shown in FIG. 23, an adjustable cable barrel clamp 45 may attach to end 44 so that end 44 remains secured to lower support 20. For example, after the barrel clamp is set, the excess cord is cut. Second cord 60 may be similarly secured to lower support 20. Second lower support 30 (FIG. 1) may be similarly configured and secured to third cord 50 and fourth cord 70. From the present description, it will be appreciated that the cords may be attached to the lower supports via other suitable attachments or attachment means.

The cords may be any conventional cords, for example, a metallic or non-metallic cord. In some embodiments, the cords may be twisted wire such as a stainless steel wire, or an insulated cord, especially when the cords transmit electric power.

Figure 24:
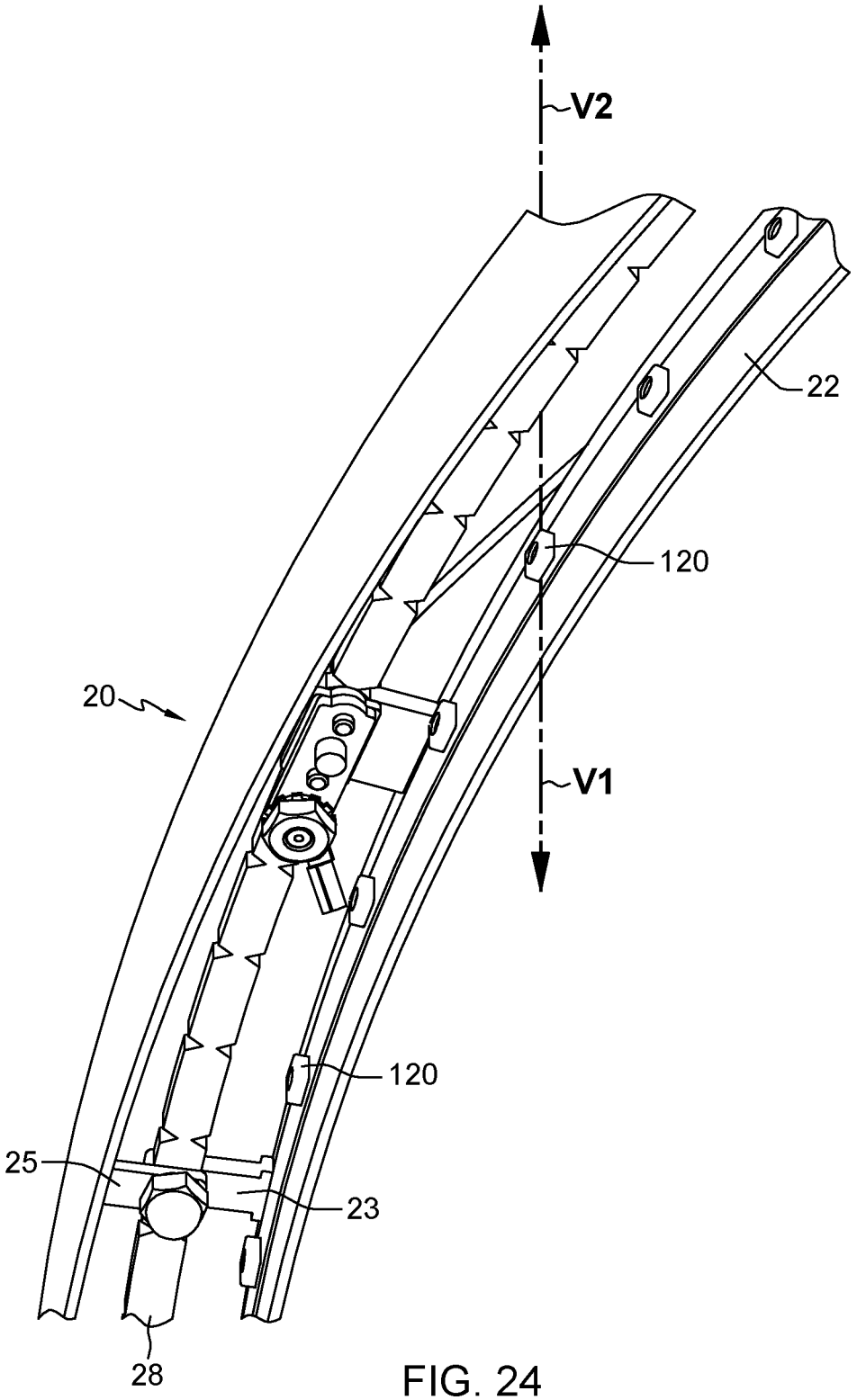
FIG. 24 is an enlarged bottom perspective view of Detail 20 of the lighting fixture of FIG. 2 with the light sources.

In some embodiments of the present disclosure, one or more of the lower supports may include light sources. As shown in FIG. 24, first lower support 20 may include one or more light sources 120 (FIGS. 20 and 24) mounted in lower support 20. For example, light sources 120 may include light-emitting diodes (LEDs) mounted to an inner surface of inner wall 22. In other embodiments, one or more light sources may be mounted to an inner surface of an outer wall of a first lower support. For larger embodiments of the present disclosure, one or more light sources may be mounted to both an inner surface of a first wall and an inner surface of an outer wall of first lower support. Light sources 120 may be mounted to by conventional means, for example, by mechanical fasteners or using an adhesive. Light sources 120 may be strip-mounted LEDs available from LED Illuminations Ltd, Llandudno, United Kingdom, such as 24V constant voltage LEDs, e.g., (LED=RI-60-5630-24 (Warm White 3000K) and (LED=RI-60-5630-24 (Natural White 4000K). It will appreciated that other suitable LEDs may be employed. In other embodiments, different types of light sources may be employed, for example, incandescent bulbs, fluorescent bulbs, and the like.

Light sources 120 may direct light in any desired direction. In some embodiments, light sources 120 may direct light in an axial direction. For example, light may be directed by light sources 120 in a vertical direction such as in a downwardly vertical direction as indicated by arrow V1 in FIG. 24. Light may be directed a vertical direction such as in an upwardly vertical direction as indicated by arrow V2 in FIG. 24. Second lower support 30 (FIG. 1) may be configured to have lighting sources similar to first lower support 20.

As also shown in FIG. 24, first lower support 20 may include an ornament support 28 such as a crystal support ring. For example, ornament support 28 may be operably attached to mounting plates 23 and 25. A plurality of ornaments may be operably suspended from ornament support 28.

With reference again to FIG. 1, one or more cords 40, 50, 60, and 70 may be adapted to transmit electric power, for example, electric current, from a power source to one or more light sources 120 (FIG. 24).

Figure 25:
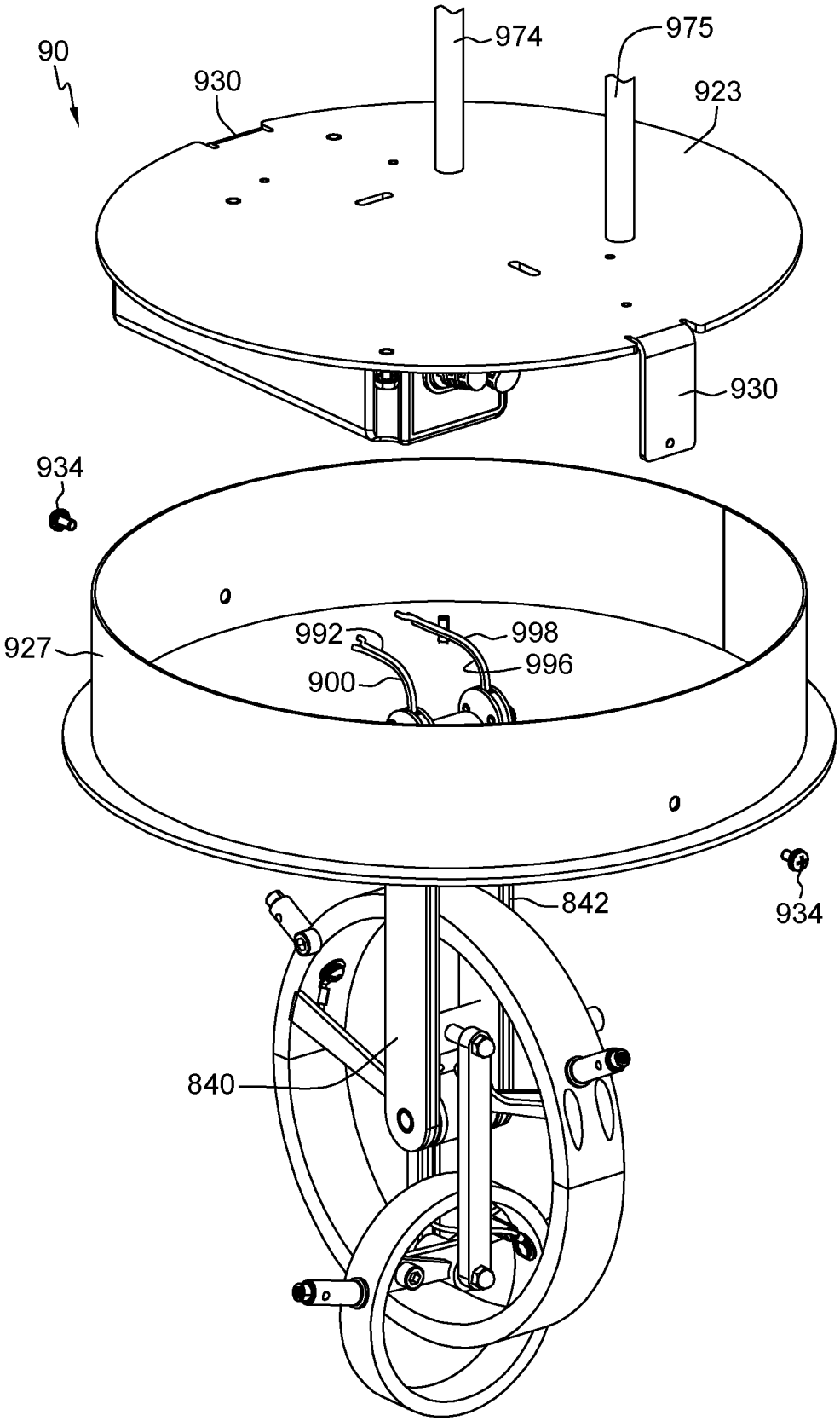
FIG. 25 is an enlarged exploded perspective view of the canopy assembly of the lighting fixture of FIG. 1.
Figure 26:
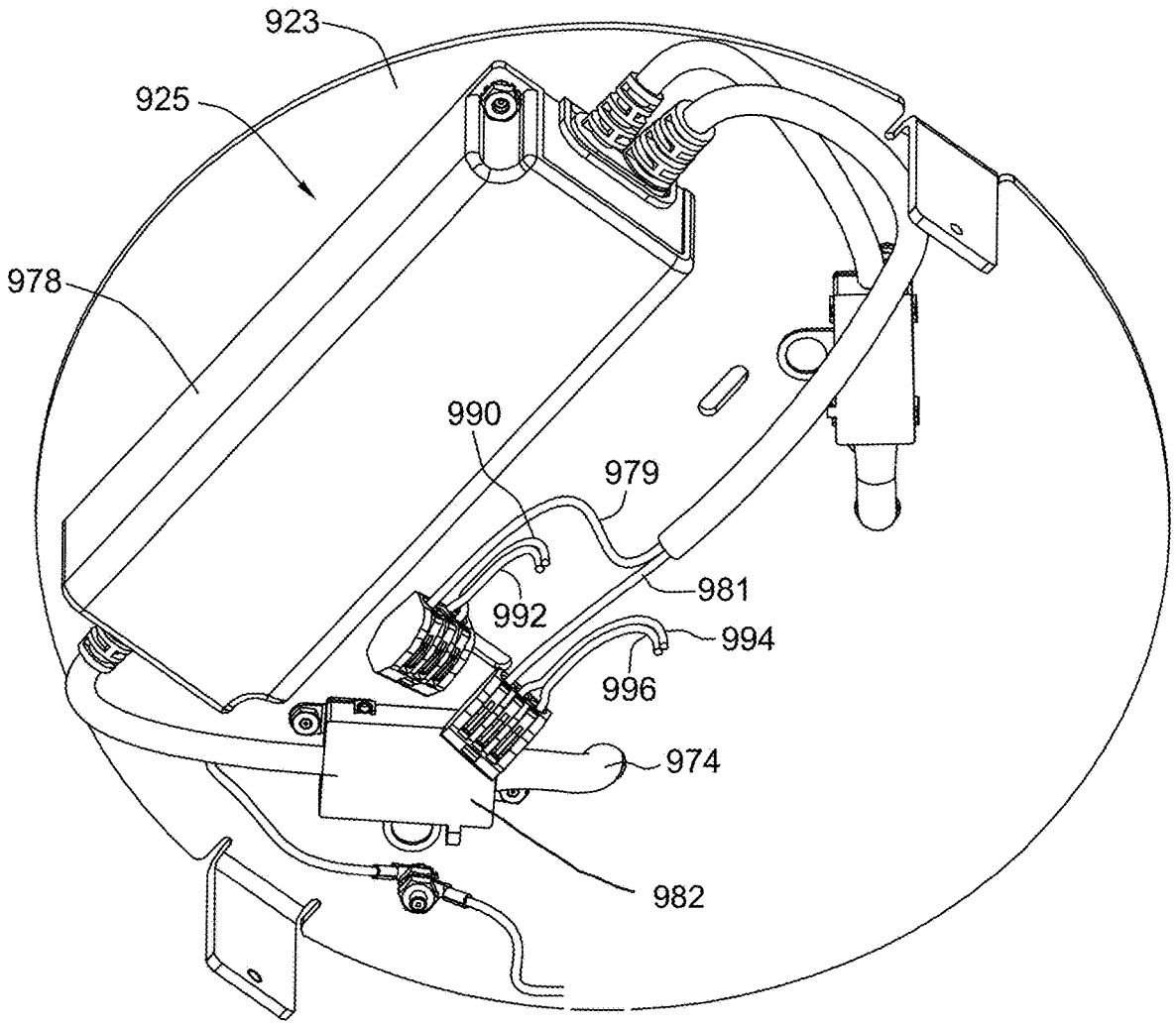
FIG. 26 is a bottom perspective view of the canopy assembly of FIG. 25.

With reference to FIGS. 25 and 26, canopy assembly 90 (FIG. 25) may include a mounting plate, or "washer," 923 and canopy cover 927 (FIG. 25) adapted to secure lighting fixture 10 (FIG. 1) to surface 12 (FIG. 1). Mounting plate 923 of canopy assembly 90 (FIG. 25) may be a thin, typically, metallic, plate adapted to be mounted to surface 12 (FIG. 1), for example, bolted to an electrical junction box (not shown) located behind surface 12 (FIG. 1). Vertical legs 840 and 842 (FIGS. 17 and 25) of upper cord support 800 (FIG. 17) may be connected to canopy cover 927 (FIG. 25).

As shown in FIG. 25, canopy cover 927 may be circular cylindrical in shape, but may take any geometry shape, including frusto-concial and polygonal cylindrical, while providing the desired functions. Cover 927 may be connected to mounting plate 923 by conventional means, for example, by means of mechanical fasteners. For example, cover 927 may be connected to mounting plate 923 by means of a pair of downwardly-dependent tabs or brackets 930 operably extending downwardly from the periphery of mounting plate 923. Lower ends of brackets 930 may be positioned and adapted to attach to canopy cover 972 with a plurality of screws 934. The engagement of brackets 930 to canopy cover 972 is typically reversible whereby screws 934 are removable to disengage lower ends of brackets 930 whereby cover 972 is removable from mounting plate 923.

As shown in FIG. 26, a power supply, wiring, and electronic 925 may typically be mounted to a surface of mounting plate 923. Electrical power may be provided to canopy assembly 90 (FIG. 25) of the lighting fixture by a wire 974, for example, a Romex-type sheathed electrical cable, as is conventional. In other embodiments, electrical power may be provided by one or more batteries positioned in a canopy assembly. Electrical power provided, for example, by wire 974, is conditioned or otherwise modified to provide electrical power to one or more support cords whereby the one or more support cords may provide electrical power to light sources in the lower supports. That is support cords may function as not only support to the lower supports, but may also be conduits for transmitting electrical power to the light sources of the lower supports. It will be appreciated that any combination of electronics and wiring that effectively provide an appropriate level of electrical power, for example, to the supports cords or to additional separate electrical wires to power the light sources may be used, and will be apparent to those of skill in the art.

Electrical power, for example, 120-240 VAC at between about 5 and 120 amperes (A), depending upon the size and number of the light sources in the lower supports, may be provided by wire 974 to canopy assembly 90 (FIG. 25). A control wire 975 may be provided for dimming lighting fixture 10 (FIG. 1), e.g., receiving 0 to 10 volts for use in dimming the lighting fixture. For example, a suitable power supply is available from by MEAN WELL Enterprises Co., Ltd. of New Taipei City, Taiwan, model PWM-90-24, a 90 W, 24V, 3.75 A constant voltage dimming LED power supply. It will appreciated that other suitable power supplies may be employed.

Wires 979 and 981 from power supply 978 may provide electrical power via wires 979 and 981 as described below. Power supply 978 may be typical power supplies adapted to convert supply voltage, for example, 120-240 VAC, to an appropriate voltage for powering the light sources, for example, about 10 to about 50 VDC. It will be appreciated that if the supply voltage provided by wire 974 is compatible with the voltage required for the light sources, for example, about 24 VDC, power supply 978 may be omitted. The output of power supply 978, for example, about 10 to about 50 VDC, may be provided to wires 979 and 981 operable for providing 24 VDC to the lighting sources via cords 990, 992, 994, and 996. In some embodiments, a plurality of power supplies may be employed. Two or more redundant power supplies may be provided to help ensure the desired power is provided and to extend the working life of the power supplies.

With reference again to FIG. 17, the output of power supply 978 (FIG. 26) is electrically connected to first and second projections 814 and 816 via wires 990 and 992, respectively, for providing electrical power to first lower support 20 (FIG. 1). Wires 990 and 992 may be operably connected to first and second projections 814 and 816 or directly to cords 40 and 60 respectively, for providing electrical power to the first lower support. Wires 996 and 994 from connection box 982 (FIG. 26) may be operably connected to projections 854 and 856 (FIG. 16) or directly to cords 50 and 70 respectively, for providing electrical power to second lower support 30 (FIG. 1).

In some embodiments, first projection and second projection may include metal and are connected to an electrical power supply. The first cord and the second cord may include metal and the middle portions of the first and second cords and the first and second projections maybe operably electrically connectable.

Cords 40, 50, 60, and 70 may be conventional wire cables, for example, AG-16-87-xxx, AG-24-01-xxx, or AG-30-20-xxx galvanized cables provided by Griplock Systems, Inc., for example, depending upon the current required in the cords or a 1/16-inch nominal diameter galvanized wire, for example, model number 3EACO23801, provided from W.A.C. of China, or their equivalents.

With reference again to FIG. 25, cords 990 and 992, and 994 and 996 may be operably receivable in vertical legs 840 and 842, respectively. As shown in FIG. 17, cords may operably attach to metal electrical eyelet terminals 943 which are secured to the projections via screws.

Where cords 40, 50, 60, and 70 carry electric current, precautions may be taken to minimize or prevent electric shock or electric shorts from the cord. For example, as shown in FIGS. 21 and 23, first lower support 20 (and similarly the second lower support) may include one or more insulating devices or sleeves (not shown) mounted adjacent ends 42 and 44 of cord 40. The insulating sleeves may be provided to electrically insulate cord 40 from first lower structure 20 from contact with cord 40. The insulating sleeves may include a cylindrical sleeve having a through hole through which cord 40 may be passed. The insulating sleeves may typically include an electrically insulating material, for example, a plastic, such as, GE Lexan polycarbonate. In addition, the insulating sleeves may protect insulation disposed about cord 40 from being damaged or cut.

With reference again to FIG. 1, ornaments 14 and 16 of lower supports 20 and 30 may be evenly distributed, for example, at a relatively constant spacing or pitch along a portion or the entire length of the lower supports. Ornaments 14 and 16 may be any conventional ornament, for example, ornaments 14 and 16 may be crystal ornaments, such as, spherical crystals, cubic crystals, diamond-shaped crystals, kite-shaped crystals, baguettes, pendeloques, icicle-shaped crystals, pear-shaped crystals, or any other crystal shapes. The ornaments may be transparent, translucent, or opaque glass, and may be made from transparent, translucent, or opaque plastic, stone, or precious gems, for example, natural or synthetic gems, such as, diamonds, rubies, or sapphires. The ornaments may include ornaments, for example, glass crystals, provided by the D. Swarovski Company of Wattens, Austria, or their equivalent. The ornaments may be mounted to the lower support by conventional means, for example, ornaments 14 and 16 may have a through hole through and connoted with a wire or hook to the lower support.

Figure 27:
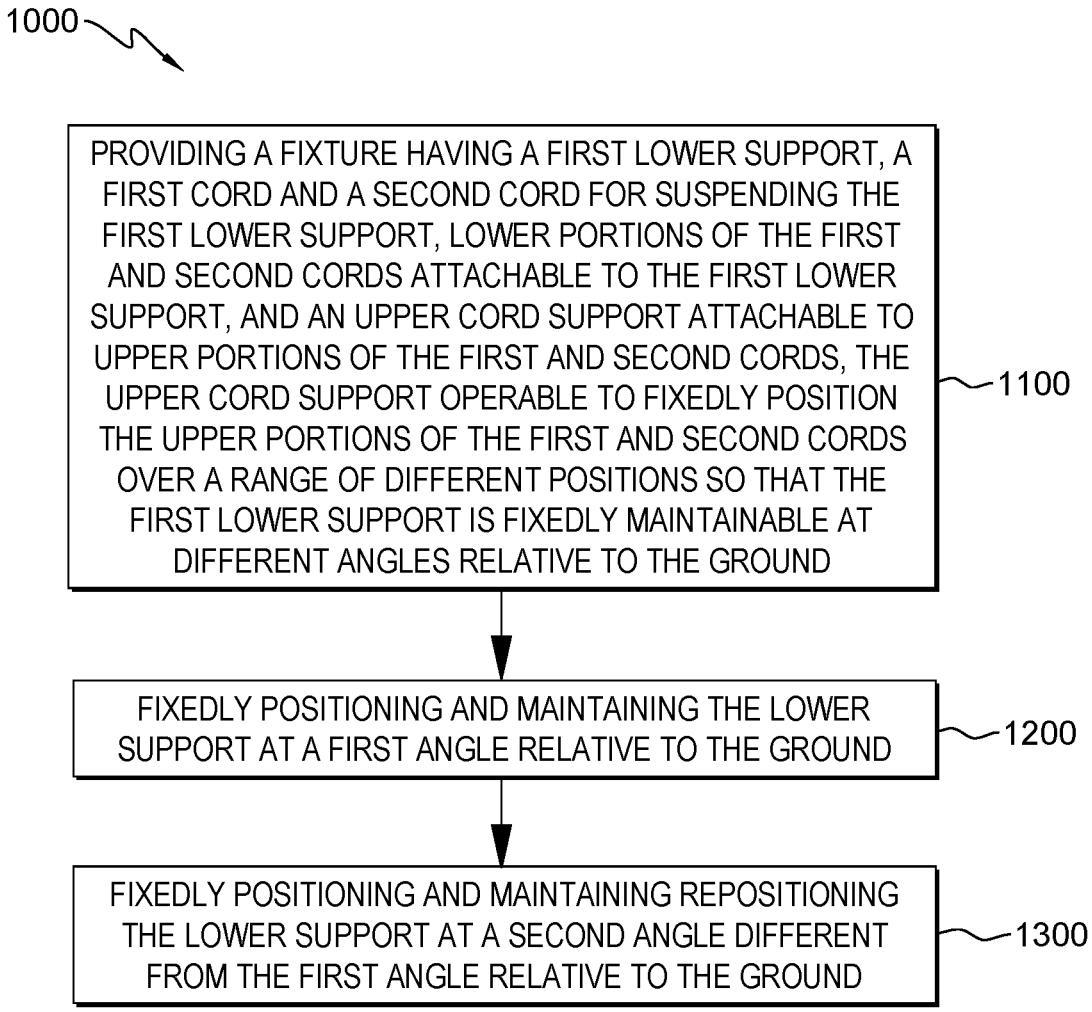
FIG. 27 is a flowchart of a method according to an embodiment of the present disclosure.

FIG. 27 illustrates a flowchart of a method 1000 for suspending a lower support according to an embodiment of the present disclosure. Method 1000 may include, for example, at 1100 providing a fixture having a first lower support, a first cord and a second cord for suspending the first lower support, lower portions of the first and second cords attachable to the first lower support, and an upper cord support attachable to upper portions of the first and second cords, the upper cord support operable to fixedly position the upper portions of the first and second cords over a range of different positions so that the first lower support is fixedly maintainable at different angles relative to the ground. At 1200, the first lower support is fixedly positioned and maintained at a first angle relative to the ground, and at 1300 the first lower support is fixedly repositioned and maintained at a second angle different from the first angle relative to the ground.

Figure 28:
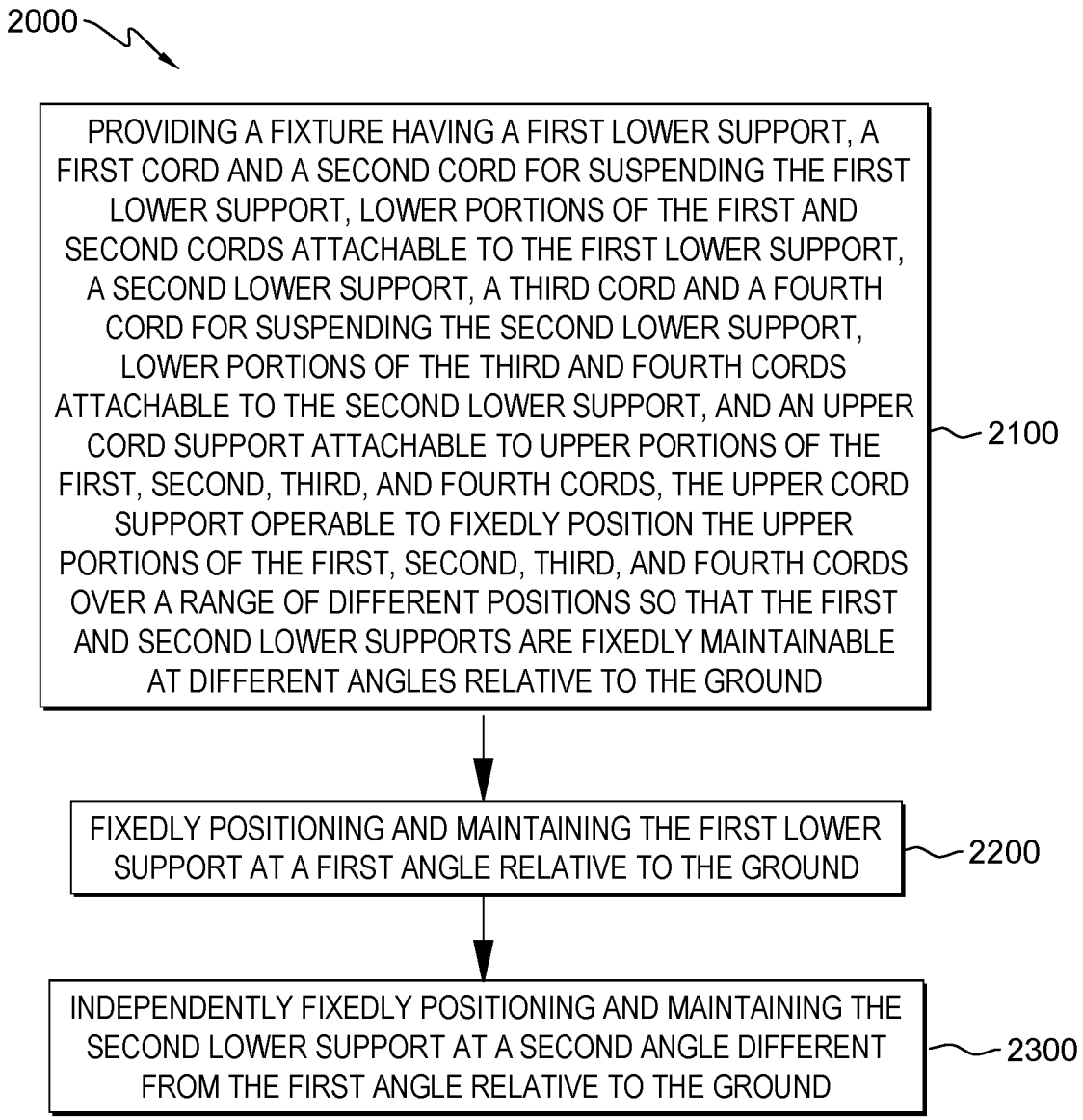
FIG. 28 is a flowchart of a method according to an embodiment of the present disclosure.

FIG. 28 illustrates a flowchart of a method 2000 for suspending a first lower support and a second lower support according to an embodiment of the present disclosure. Method 2000 may include, for example, at 2100 providing a fixture having a first lower support, a first cord and a second cord for suspending the first lower support, lower portions of the first and second cords attachable to the first lower support, a second lower support, a third cord and a fourth cord for suspending the second lower support, lower portions of the third and fourth cords attachable to the second lower support, and an upper cord support attachable to upper portions of the first, second, third, and fourth cords, the upper cord support operable to fixedly position the upper portions of the first, second, third, and fourth cords over a range of different positions so that the first and second lower supports are fixedly maintainable at different angles relative to the ground. At 2200 the first lower support is fixedly positioned and maintained at a first angle relative to the ground, and at 2300 the second lower support is independently fixedly positioned and maintained at a second angle different from the first angle relative to the ground.

Figure 29:
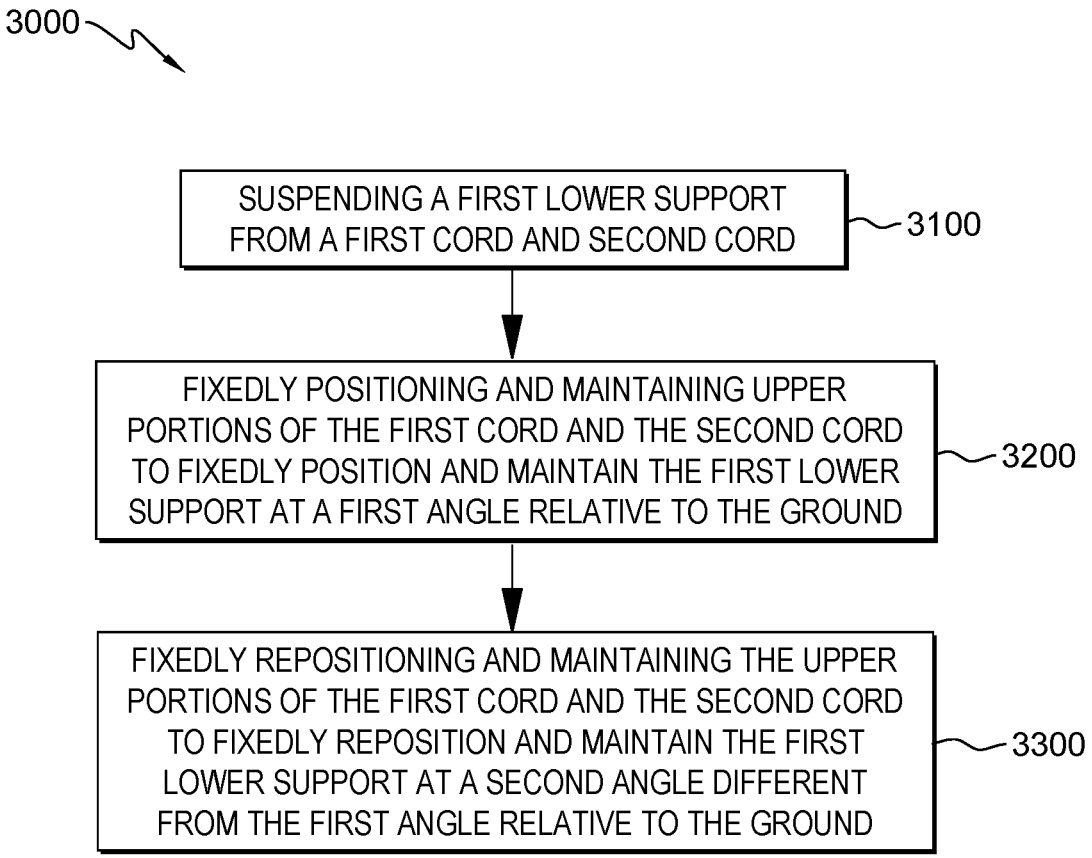
FIG. 29 is a flowchart of a method according to an embodiment of the present disclosure.

FIG. 29 illustrates a flowchart of a method 3000 for suspending a first lower support according to an embodiment of the present disclosure. Method 2000 may include, for example, at 3100 suspending the first lower support from a first cord and second cord, at 3200 fixedly positioning and maintaining upper portions of the first cord and the second cord to fixedly position and maintain the first lower support at a first angle relative to the ground, and at 3300 fixedly repositioning and maintaining the upper portions of the first cord and the second cord to fixedly reposition and maintain the first lower support at a second angle different from the first angle relative to the ground.

Figure 30:
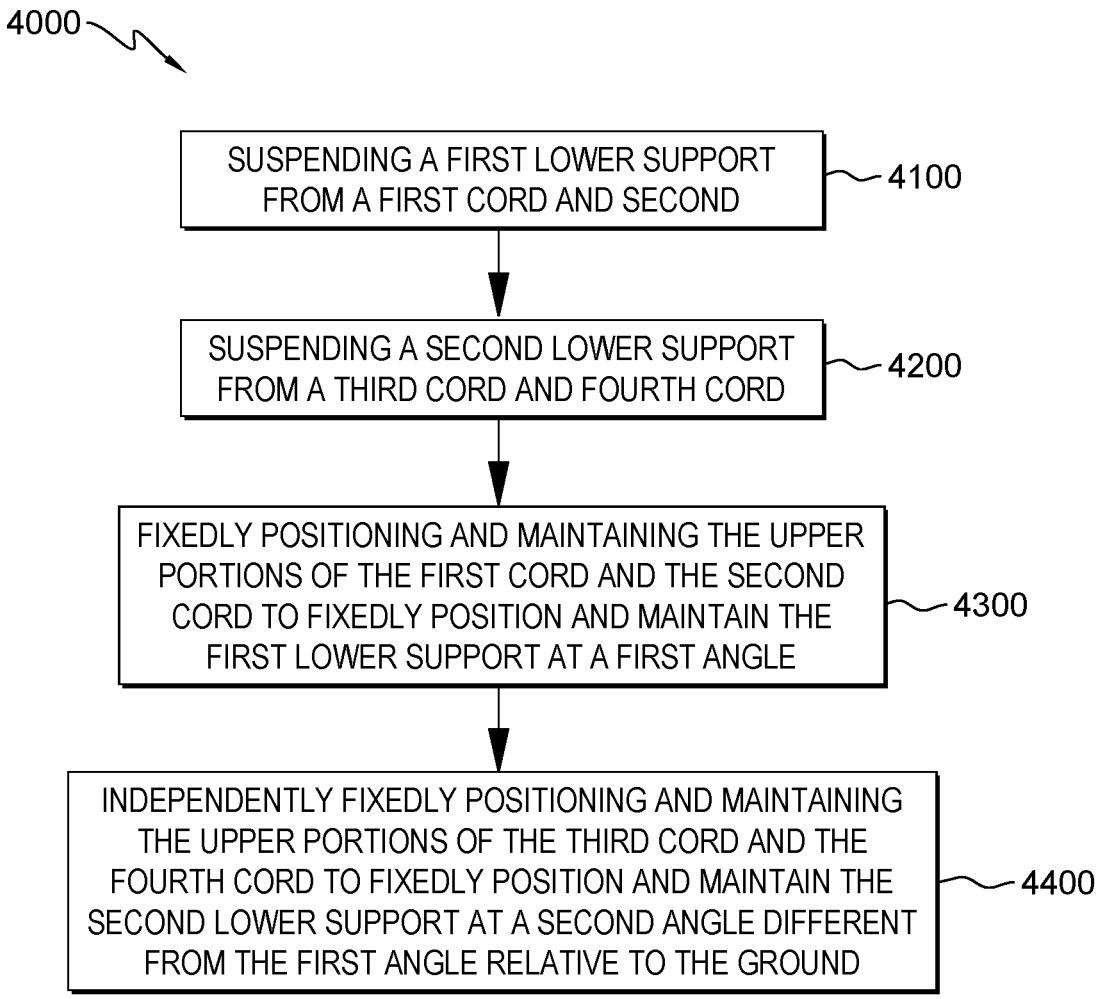
FIG. 30 is a flowchart of a method according to an embodiment of the present disclosure.

FIG. 30 illustrates a flowchart of a method 4000 for suspending a first lower support according to an embodiment of the present disclosure. Method 4000 may include, for example, at 4100 suspending a first lower support from a first cord and second, at 4200 suspending a second lower support from a third cord and fourth cord, at 4300 fixedly positioning and maintaining the upper portions of the first cord and the second cord to fixedly position and maintain the first lower support at a first angle, and at 4400 independently fixedly positioning and maintaining the upper portions of the third cord and the fourth cord to fixedly position and maintain the second lower support at a second angle different from the first angle relative to the ground.

As described above, the present disclosure provides fixtures and lighting fixtures having suspended elements or portions having adjustable and maintainable angular or orientational configurations without user intervention after positioning or repositioning. Suspension cables may be attached to one or more upper cords supports such as one or more rotatable members which allow one or more lower supports such as one or more rings to be adjusted at a variety of angles or orientations based on the user's preference. Accordingly, the present disclosure provides suspended fixtures and lighting fixtures having additional features of adjusting and maintaining the angle or orientation of one or lower supports through a range of different positions compared to conventional suspended lighting fixtures which may adjustably allow vertical repositioning of a lower support or supports but not angular or orientational adjustment of the lower support or supports, i.e., the conventional lower support or supports may be change vertical position relative to the ground but remains at the same angle and in the same orientation relative to the ground. In further embodiments, in addition to the support cords, separate electrical cords may be may be provided for providing electrical power to the light sources. In further embodiments, instead of the support cords passing through the projections, the support cords may wrap around the protections or pins extending from the projections. In further embodiments, the support cords may be disposed or wrap over the rotatable members.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of one or more aspects of the present disclosure and the practical application, and to enable others of ordinary skill in the art to understand one or more aspects of the disclosure for various embodiments with various modifications as are suited to the particular use contemplated.

The invention claimed is:

1. A fixture comprising:

a first lower support;

a first cord and a second cord, said first and second cords configured for suspending said first lower support, lower portions of said first and second cords attachable to said first lower support;

a second lower support;

a third cord and a fourth cord, said third and fourth cords configured for suspending said second lower support, lower portions of said third and fourth cords attachable to said second lower support;

an upper cord support comprising:

a first rotatable member rotatable about a first axis, said first rotatable member attachable to upper portions of said first and second cords;

a second rotatable member rotatable about a second axis, said second rotatable member attachable to upper portions of said third and fourth cords;

said first rotatable member operable to fixedly position said upper portions of said first and second cords over a range of first different positions so that said first lower support is fixedly maintainable at first different angles relative to a horizontal plane;

said second rotatable member operable to fixedly position said upper portions of said third and fourth cords over a range of second different positions so that said second lower support is fixedly maintainable at second different angles relative to the horizontal plane; and wherein said second lower support is disposed within said first lower support.

2. The fixture of claim 1 wherein a) said upper cord support comprises frictionally engageable portions to fixedly position said upper portions of said first and second cords over said range of first different positions so that said first lower support is fixedly maintainable at said first different angles relative to the horizontal plane, and/or b) said upper cord support comprises frictionally engageable portions to fixedly position said upper portions of said third and fourth cords over said range of second different positions so that said second lower support is fixedly maintainable at said second different angles relative to the horizontal plane.

3. The fixture of claim 1 wherein a) said first rotatable member is frictionally restrained between a pair of first vertical legs to fixedly position said upper portions of said first and second cords over said range of first different positions so that said first lower support is fixedly maintainable at said first different angles relative to the horizontal plane, and/or b) said second rotatable member is frictionally restrained between a pair of second vertical legs to fixedly position said upper portions of said third and fourth cords over said range of second different positions so that said second lower support is fixedly maintainable at said second different angles relative to the horizontal plane.

4. The fixture of claim 1 wherein said first rotatable member comprises a rotatable ring member and/or said second rotatable member comprises a rotatable ring member.

5. The fixture of claim 1 wherein said first axis is offset from a center of said first rotatable member and/or said second axis is offset from a center of said second rotatable member.

6. The fixture of claim 1 wherein a) opposite ends of said first cord are attachable to said first lower support and a middle portion of said first cord is supported by said first rotatable member, and opposite ends of said second cord are attachable to said first lower support and a middle portion of said second cord is supported by said first rotatable member, and/or b) opposite ends of said third cord are attachable to said second lower support and a middle portion of said third cord is supported by said second rotatable member, and opposite ends of said fourth cord are attachable to said second lower support and a middle portion of said fourth cord is supported by said second rotatable member.

7. The fixture of claim 1 wherein said first lower support comprises at least one light source and/or said second lower support comprises at least one light source.

8. The fixture of claim 7 wherein at least one of said first cord and said second cord is adapted to provide an electrical power supply to said at least one light source of said first lower support, and/or at least one of said third cord and said fourth cord is adapted to provide an electrical power supply to said at least one light source of said second lower support.

9. The fixture of claim 1 wherein said first lower support comprises a closed loop and/or said second lower support comprises a closed loop.

10. The fixture of claim 1 further comprising a plurality of ornaments supported from at least one of said first lower support and said second lower support.

11. The fixture of claim 1 wherein a) said lower portions of said first and second cords comprise a lower portion of said first cord and a lower portion of said second cord, said lower portion of said first cord and said lower portion of said second cord are adjustably connectable to said first lower support to allow positioning said first lower support at different distances from said first rotatable member, and/or b) said lower portions of said third and fourth cords comprise a lower portion of said third cord and a lower portion of said fourth cord, said lower portion of said third cord and said lower portion of said fourth cord are adjustably connectable to said second lower support to allow positioning said second lower support at different distances from said second rotatable member.

12. The fixture of claim 1 wherein a) said upper portions of said first and second cords comprise an upper portion of said first cord and an upper portion of said second cord, said first rotatable member comprises a first projection for supporting said upper portion of said first cord and a second projection for supporting said upper portion of said second cord, and/or b) said upper portions of said third and fourth cords comprise an upper portion of said third cord and an upper portion of said fourth cord, said second rotatable member comprises a third projection for supporting said upper portion of said third cord and a fourth projection for supporting said upper portion of said fourth cord.

13. The fixture of claim 12 wherein a) opposite ends of said first cord are attachable to said first lower support and a middle portion of said first cord is supported by said first projection, and opposite ends of said second cord are attachable to said first lower support and a middle portion of said second cord is supported by said second projection, and/or b) opposite ends of said third cord are attachable to said second lower support and a middle portion of said third cord is supported by said third projection, and opposite ends of said fourth cord are attachable to said second lower support and a middle portion of said fourth cord is supported by said fourth projection.

14. The fixture of claim 13 wherein a) said first projection and said second projection comprise metal and are connectable to an electrical power, said first cord and said second cord comprise metal, and said middle portions of said first and second cords and said first and second projections are operably electrically connectable to the electrical power, and/or b) said third projection and said fourth projection comprise metal and are connectable to the electrical power, said third cord and said fourth cord comprise metal, and said middle portions of said third and fourth cords and said third and fourth projections are operably electrically connectable to the electrical power.

15. The fixture of claim 1 wherein said upper cord support is operable to fixedly position said upper portions of said first and second cords independently from fixedly positioning said upper portions of said third and fourth cords.

16. The fixture of claim 1 wherein said first rotatable member comprises a hub frictionally engageable with first vertically extending legs to fixedly position said upper portions of said first and second cords over said range of first different positions so that said first lower support is fixedly maintainable at said first different angles relative to the horizontal plane, and said second rotatable member comprises a hub frictionally engageable with second vertically extending legs to fixedly position said upper portions of said third and fourth cords over said range of second different positions so that said second lower support is fixedly maintainable at said second different angles relative to the horizontal plane.

17. The fixture of claim 1 wherein said first rotatable member comprises said first axis offset from a center of said first rotatable member, and said second rotatable member comprises said second axis offset from a center of said second rotatable member.

18. The fixture of claim 1 wherein said first lower support comprises a first circular ring, and said second lower support comprise a second circular ring.

19. The fixture of claim 1 wherein said first lower support comprises at least one light source and said second lower support comprises at least one light source.

20. The fixture of claim 1 further comprising a plurality of ornaments supported from said first lower support, and a plurality of ornaments supported from said second lower support.

21. The fixture of claim 1 wherein said second rotatable member extends around said first rotatable member.

22. The fixture of claim 1 wherein said first rotatable member comprises a rotatable ring member and said second rotatable member comprises a rotatable ring member.

23. The fixture of claim 1 wherein said first axis is not parallel to said second axis.

24. The fixture of claim 1 wherein said first lower support comprises a closed loop and said second lower support comprises a closed loop.

25. The fixture of claim 1 wherein said first lower support comprises at least one light source, said second lower support comprises at least one light source, at least one of said first cord and said second cord is adapted to provide an electrical power supply to said at least one light source of said first lower support, and at least one of said third cord and said fourth cord is adapted to provide an electrical power supply to said at least one light source of said second lower support.

26. The fixture of claim 1 wherein said upper cord support comprises frictionally engageable portions to fixedly position said upper portions of said first and second cords over said range of first different positions so that said first lower support is fixedly maintainable at said first different angles relative to the ground horizontal plane, and said upper cord support comprises frictionally engageable portions to fixedly position said upper portions of said third and fourth cords over said range of second different positions so that said second lower support is fixedly maintainable at said second different angles relative to the horizontal plane.

27. The fixture of claim 1 wherein said upper portions of said first and second cords comprise an upper portion of said first cord and an upper portion of said second cord, said first rotatable member comprises a first projection for supporting said upper portion of said first cord and a second projection for supporting said upper portion of said second cord, and said upper portions of said third and fourth cords comprise an upper portion of said third cord and an upper portion of said fourth cord, said second rotatable member comprises a third projection for supporting said upper portion of said third cord and a fourth projection for supporting said upper portion of said fourth cord.

28. The fixture of claim 27 wherein opposite ends of said first cord are attachable to said first lower support and a middle portion of said first cord is supported by said first projection, and opposite ends of said second cord are attachable to said first lower support and a middle portion of said second cord is supported by said second projection, and wherein opposite ends of said third cord are attachable to said second lower support and a middle portion of said third cord is supported by said third projection, and opposite ends of said fourth cord are attachable to said second lower support and a middle portion of said fourth cord is supported by said fourth projection.

29. The fixture of claim 28 wherein said first projection and said second projection comprise metal and are connectable to an electrical power, said first cord and said second cord comprise metal, and wherein said middle portions of said first and second cords and said first and second projections are operably electrically connectable to the electrical power, and said third projection and said fourth projection comprise metal and are connectable to the electrical power, said third cord and said fourth cord comprise metal, and wherein said middle portions of said third and fourth cords and said third and fourth projections are operably electrically connectable to the electrical power.

30. A method comprising:

providing the fixture of claim 1 suspended from above;

fixedly positioning and maintaining the first lower support at a first angle relative to the horizontal plane; and fixedly repositioning and maintaining the first lower support at a second angle different from the first angle relative to the horizontal plane.

31. The method of claim 30 wherein the fixedly repositioning and maintaining comprises rotating said upper portions of the first cord and the second cord about the first axis.

32. The method of claim 30 wherein the first lower support comprises one or more light sources.

33. A method comprising:

providing the fixture of claim 1 suspended from above;

fixedly positioning and maintaining the first lower support at a first angle relative to the horizontal plane; and independently fixedly positioning and maintaining the second lower support at a second angle different from the first angle relative to the horizontal plane.

34. The method of claim 33 wherein the fixedly positioning and maintaining the first lower support comprises rotating the upper portions of the first cord and the second cord about the first axis, and the independently fixedly positioning and maintaining the second lower support comprises rotating the upper portions of the third cord and the fourth cord about the second axis.

35. The method of claim 33 wherein the first lower support comprises one or more light sources, and the second lower support comprises one or more light sources.

* * * * *